US011228147B2

(12) United States Patent
Rutz et al.

(10) Patent No.: US 11,228,147 B2
(45) Date of Patent: Jan. 18, 2022

(54) ASSEMBLY OF DISCONNECT TERMINALS HAVING A COUPLING DEVICE, AND SWITCHING STATUS DISPLAY

(71) Applicant: Weidmüller Interface GmbH & Co. KG, Detmold (DE)

(72) Inventors: Andreas Rutz, Bielefeld (DE); Genadij Neumann, Detmold (DE); Peter Meyer, Bad Salzuflen (DE)

(73) Assignee: Weidmüller Interface GmbH & Co. KG

( * ) Notice: Subject to any disclaimer, the term of this patent is extended or adjusted under 35 U.S.C. 154(b) by 0 days.

(21) Appl. No.: 16/916,695

(22) Filed: Jun. 30, 2020

(65) Prior Publication Data

US 2021/0066864 A1 Mar. 4, 2021

(30) Foreign Application Priority Data

Aug. 30, 2019 (DE) ..... 102019123285.6

(51) Int. Cl.
*H01R 13/70* (2006.01)

(52) U.S. Cl.
CPC ..... *H01R 13/70* (2013.01)

(58) Field of Classification Search
CPC ..... H01R 13/70; H01R 13/7032; H01H 71/1018; H01H 71/04; H01H 2071/042; H01H 9/26
See application file for complete search history.

(56) References Cited

U.S. PATENT DOCUMENTS

| | | | | |
|---|---|---|---|---|
| 2,277,645 | A | 3/1942 | Johnson | |
| 3,069,517 | A | 12/1962 | Cole | |
| 5,700,986 | A | 12/1997 | Rüpup et al. | |
| 8,581,131 | B2 * | 11/2013 | Pollmann | H01R 9/2633 200/554 |
| 2011/0062011 | A1 | 3/2011 | Pollmann | |

FOREIGN PATENT DOCUMENTS

| | | | |
|---|---|---|---|
| DE | 4444551 | A1 | 6/1996 |
| DE | 4444556 | A1 | 6/1996 |
| DE | 19848264 | C1 | 5/2000 |
| DE | 102008014176 | A1 | 9/2009 |
| DE | 202011021798 | U1 | 2/2013 |

* cited by examiner

*Primary Examiner* — Vanessa Girardi
(74) *Attorney, Agent, or Firm* — Laubscher & Laubscher, P.C.

(57) ABSTRACT

An assembly includes at least two disconnect terminals and at least one coupling device, wherein the at least two disconnect terminals each include at least one switching lever. Each switching lever is adjustable independently from the other switching lever from a first switch position into at least one second switch position and back, wherein the switching levers are connectable by the at least one coupling device. The at least one coupling device connects the switching levers if the at least one coupling device is switched into at least one first coupling position, and the at least one coupling device separates the switching levers from one another if the at least one coupling device is switched into at least one second coupling position. A disconnect terminal includes the at least one coupling device.

22 Claims, 33 Drawing Sheets

11
14
13
12a
15
7'c
8'a
7c
12
12b
15
16
8a
17b
17a
17
7'
6'a
6'
6
6a
7

11
14
B
14a
7'c
A
13
12
12a
12b
17a
16
17b
17
7'
6'a
6'
6
6a
7

11
14
7c;7'c
B
A
14a
17b
12a
7'
6'a
6'
6
6a
7
17a
17
16

Fig. 25
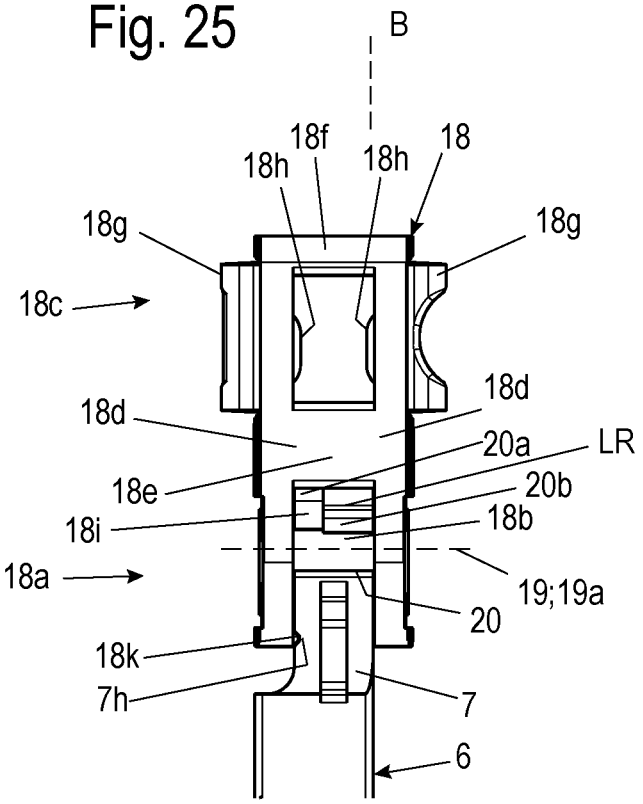
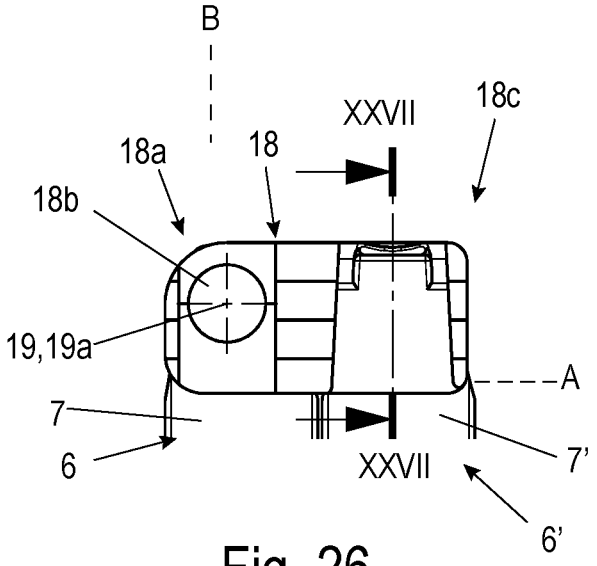
Fig. 26
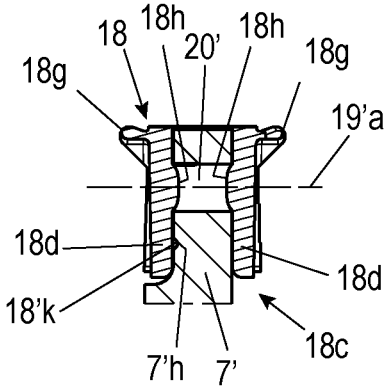
Fig. 27

ASSEMBLY OF DISCONNECT TERMINALS HAVING A COUPLING DEVICE, AND SWITCHING STATUS DISPLAY

This application claims priority if DE 10 2019 123 285.6 filed Aug. 30, 2019. The entire contents of this application is incorporated herein by reference.

BACKGROUND OF THE INVENTION

The present invention relates to an arrangement of disconnect terminals having at least one coupling device. The invention also relates to an disconnect terminal having a coupling device and to a disconnect terminal having a switch status display.

Disconnect terminals of this type are used in different applications.

BRIEF DESCRIPTION OF THE PRIOR ART

DE 44 44 551 A1 describes a current transformer disconnect terminal having a switching piece in the form of an angle-adjustable contact disk, which ensures by a contact drag line that the secondary side of a connected current transformer can never be open when the current passage is separated or closed by the terminal. The contact disk is adjustable in the angle around an axis of rotation by a pivot lever. The actuation of the current transformer disconnect terminal, i.e., the manual pivoting of the pivot lever from the one switch position into the other in the case of multiple directly adjacent disconnect terminals can be performed together in that a coupling pin is inserted into the handle knobs of the pivot levers of the directly adjacent disconnect terminals.

DE 44 44 556 A1 relates to switchable terminal blocks having a switching lever handle made of insulating material. The handle is provided with two visible surfaces, of which, in each of the two alternate switch positions of the switching lever, the one visible surface faces toward the viewing direction of the operator and the other visible surface faces away from the viewing direction of the operator in the same switch position. The handles of directly adjacent terminal blocks can be coupled by a transparent cap that overlaps two or more handles.

DE 10 2008 014 176 B4 describes a terminal block and also a series disconnecting switch with a knife disconnect for pivotable arrangement in a terminal housing of the terminal block, wherein a busbar having two parts and two conductor connection elements for connecting one conductor to each part of the busbar are arranged in the terminal housing, wherein the two parts are connected to one another in a first position of the knife disconnect and are separated from one another in a second position of the knife disconnect. The knife disconnect is partially enclosed by an insulating housing. Actuation of the series disconnecting switch can be performed not only with the aid of a screwdriver, which is inserted for this purpose into an actuating shaft of the insulating housing, but rather also with the aid of a switch connection, which includes two legs and a handle section connecting the legs. Two series disconnecting switches of two terminal blocks arranged adjacent to one another can thus be actuated simultaneously, for which purpose one leg is inserted into the actuating shaft of each series disconnecting switch.

The known disconnect terminals have proven themselves as such. It is considered disadvantageous that a separate adjustment of the switching levers connected to connecting elements independently of one another is only possible if the connecting element is removed again.

However, it is desirable to refine these disconnect terminals, wherein a simple, rapid, and reversible switch connection is enabled and a compact structure and a small number of components is maintained or improved, and wherein simultaneous recognition of the switch position is enabled.

SUMMARY OF THE INVENTION

An arrangement according to the invention includes at least two disconnect terminals and at least one coupling device, wherein the at least two disconnect terminals each include at least one switching lever, wherein each switching lever is adjustable independently from the other switching lever from a first switch position into at least one second switch position and back, wherein the switching levers are connectable by the at least one coupling device. The at least one coupling device connects the switching levers to one another if the at least one coupling device is switched into at least one first coupling position, and the at least one coupling device separates the switching levers from one another if the at least one coupling device is switched into at least one second coupling position.

This results in an advantageously simple and rapid connection of switching levers of the disconnect terminals and also a similarly simple and rapid reversal of the connection of the switching levers by the coupling device in two different coupling positions. Moreover, other coupling configurations can be enabled by further coupling positions.

A further advantage is that all disconnect terminals having the same structure can be used.

Moreover, it is possible that not only two, but rather switching levers of multiple disconnect terminals can be connected in an advantageously simple manner.

A disconnect terminal according to the invention includes the above-described coupling device.

A further disconnect terminal according to the invention, in particular for the arrangement specified above, includes at least one switching lever, wherein the switching lever is adjustable independently from the other switching lever from a first switch position at least into a second switch position and back. The disconnect terminal includes a switch status display having a movable display portion and a fixed display portion, wherein the switch status display visibly displays the respective switch position or at least one further switch position, wherein in the first switch position these two display portions are unified so that a "closed" symbolism is visibly apparent, and wherein in the second switch position this symbolism is separated, from which a separation is apparent.

An advantageously simple and unambiguous display of switching states is thus enabled.

It is to be noted that such a switch status display can also be used for other terminal types which do not include coupling elements. Such a terminal having switch status display can also be the subject matter of a separate application.

In one embodiment, the at least one coupling device includes at least one coupling element, which is switchable from the at least one first coupling position into the at least one second coupling position or into at least one further coupling position and back. It is advantageous that the coupling element is switchable, since unique switching states are thus enabled.

It is additionally advantageous that the at least one coupling element is held captively on the switching lever of one of the at least two disconnect terminals.

One embodiment provides that the at least one coupling element is switchable linearly in the radial direction in relation to a pivot axis of the switching lever from the at least one first coupling position into the at least one second coupling position or into the at least one further coupling position and back. The switching is thus achieved with a simple linear pull and push procedure.

Another embodiment provides that the at least one coupling element is switchable linearly in the radial direction in relation to a pivot axis of the switching lever from the at least one first coupling position into the at least one second coupling position or into the at least one further coupling position and back perpendicularly or at an angle in relation to the movement direction of a switching lever.

In one embodiment, the at least one coupling element includes at least one switch pin, at least one driver, and at least one handle, wherein the at least one switch pin is longer than the at least one driver. This is advantageous since the longer switch pin can remain in its arrangement in both coupling positions, even if the driver is no longer engaged.

For this purpose, a further embodiment provides that the at least one coupling element is accommodated in a displaceably guided manner with the at least one switch pin in a receptacle of the one switching lever of the at least one disconnect terminal and is fixed by a detent mechanism in each case in the at least one first coupling position and in the at least one second coupling position or in the at least one further coupling position. The coupling positions can thus be easily determined.

It is moreover advantageous that the at least one switch pin of the at least one coupling element includes a lug and at least one detent spring having at least one detent lug as a detent mechanism, since a simple and compact detent mechanism is formed in this manner.

In a further embodiment, the at least one driver is engaged in the at least one first coupling position with at least one receptacle of the adjacent or at least one closest switching lever or at least one switching lever arranged remotely in a grid, and the at least one driver is disengaged in the at least one coupling position or in the at least one further coupling position from the at least one receptacle of the adjacent or the at least one closest switching lever or at least one switching lever arranged remotely in a grid. One advantage in this case is the simple and compact structure.

An alternative embodiment provides that the at least one coupling element is switchable rotationally around an axis from the at least one first coupling position into the at least one second coupling position or into the at least one further coupling position and back, wherein the axis is tangential to an imaginary circle having a center point, through which a pivot axis of the switching lever extends, or the axis is coaxial or at an angle in relation to the movement direction of a switching lever. This is simple and space-saving.

In a further embodiment, the at least one coupling element is a type of oblong hood and includes a pivot section, a shaft section having an axis, and at least one coupling section, wherein the shaft section of the at least one coupling element is accommodated so it is pivotable around the axis in a receptacle of a radially protruding actuating section of the switching lever and is held captively by a suitable device, for example, an undercut. It is also advantageous in this case that the coupling device can be retrofitted easily.

It is advantageous that the at least one coupling element is pivoted in the at least one first coupling position via the radially protruding actuating section of at least the adjacent or at least one closest switching lever or at least one switching lever arranged remotely in a grid and is coupled at least thereto in a formfitting manner, wherein the at least one coupling section of the at least one coupling element encloses in a hood-like manner the radially protruding actuating section of at least the adjacent or at least one closest switching lever or at least one switching lever arranged remotely in a grid, since in this manner the switching state of the switching lever is also particularly clearly visible.

In a further embodiment, the at least one coupling element is held in the at least one first coupling position in a first detent position, wherein at least one projection on the inner sides of side walls of the at least one coupling section of the at least one coupling element are engaged with ends of the receptacle of the actuating section of at least the adjacent or at least one closest switching lever or at least one switching lever arranged remotely in a grid. The at least one coupling element is held in the at least one second coupling position in a second detent position. A protruding section is attached in one embodiment on the movable coupling element and a corresponding indented section is located on a fixed part, for example, on the actuating section. Of course, it is also possible for the protruding section to be arranged on the fixed part, and the indented section to be located on the movable coupling element. It is also conceivable that a combination of two or more such detent devices is provided. The protruding section of one detent device can be attached on the movable coupling element, and the protruding section of the other detent device is fixed. One advantage in this case is a simple structure and the usability of similarly designed disconnect terminals.

In another alternative embodiment, the at least one pivotable coupling element is arranged pivotably around at least one axis and captively in each case in a receptacle in at least one actuating section of the at least one switching lever, wherein the respective receptacle includes at least one slot through which the at least one coupling element is installable. One advantage in this case is the space-saving and a particularly compact structure.

A further embodiment provides that the at least one coupling element includes in each case a cylindrical body having an associated pivot axis and at least one arm attached to the body having at least one hook section. A narrow and space-saving structure is thus possible.

In still a further embodiment, the at least one hook section extends in the at least one first coupling position through the at least one slot and is engaged with at least one further receptacle of the actuating section of at least the adjacent or at least one closest switching lever or at least one switching lever arranged remotely in a grid, wherein the at least one hook section remains in the respective corresponding receptacle in the at least one second coupling position. This is advantageous, since a particularly compact structure may be enabled.

For an advantageous determination of the coupling positions, the at least one coupling element is locked in each of the at least one first coupling position and in the at least one second coupling position or in the at least one further coupling position by at least one lug, which is engaged in the respective coupling position with a respective fixed recess.

It is additionally advantageous that the at least one coupling element is switchable by a tool, since no additional functional parts have to be externally introduced to the switching lever and enlarge the switching labor.

In still a further embodiment, the at least one actuating section of the at least one switching lever having the corresponding receptacles can be formed having the at least one coupling element and the corresponding receptacles as at least one box-shaped region or receptacle section each as a separate part, which is attached in a suitable manner to the at least one switching lever. Advantageous retrofitting and installation is thus possible. The actuating section can thus be manufactured and installed separately.

It is moreover advantageous that the disconnect terminal includes a switch status display having a movable display portion and a fixed display portion, which visibly displays the respective switch position or at least one further switch position of the switching lever, wherein in the at least one first switch position, these two display portions are unified so that a "closed" symbolism is visibly apparent, and wherein in the second switch position this symbolism is separated, from which a separation is apparent.

A further embodiment provides that at least the first switch position is displayed by covering and/or making a display portion visible and at least the second switch position is displayed by making a display portion visible or covered. This results in a compact structure.

In still a further embodiment, the switch status display advantageously assists recognizability by way of coloring, symbolism, and/or geometry.

In one embodiment of the disconnect terminal, at least the first switch position is displayed by covering and/or making visible a display portion and at least the second switch position is displayed by making visible and/or covering a display portion. Such a structure is advantageously compact.

In a further embodiment of the disconnect terminal, the switch status display assists recognizability by way of coloring, symbolism, and/or geometry. This is advantageous since the recognizability is also possible from a greater distance.

BRIEF DESCRIPTION OF THE FIGURES

The invention is described in greater detail hereinafter with the aid of exemplary embodiments with reference to the accompanying drawings, in which:

FIGS. 23-27 are various views of a coupling element of the second exemplary embodiment according to FIG. 17;

DETAILED DESCRIPTION

The terms "top", "bottom", "left", "right" refer to the respective arrangement of the components in the figures.

Figure 1:
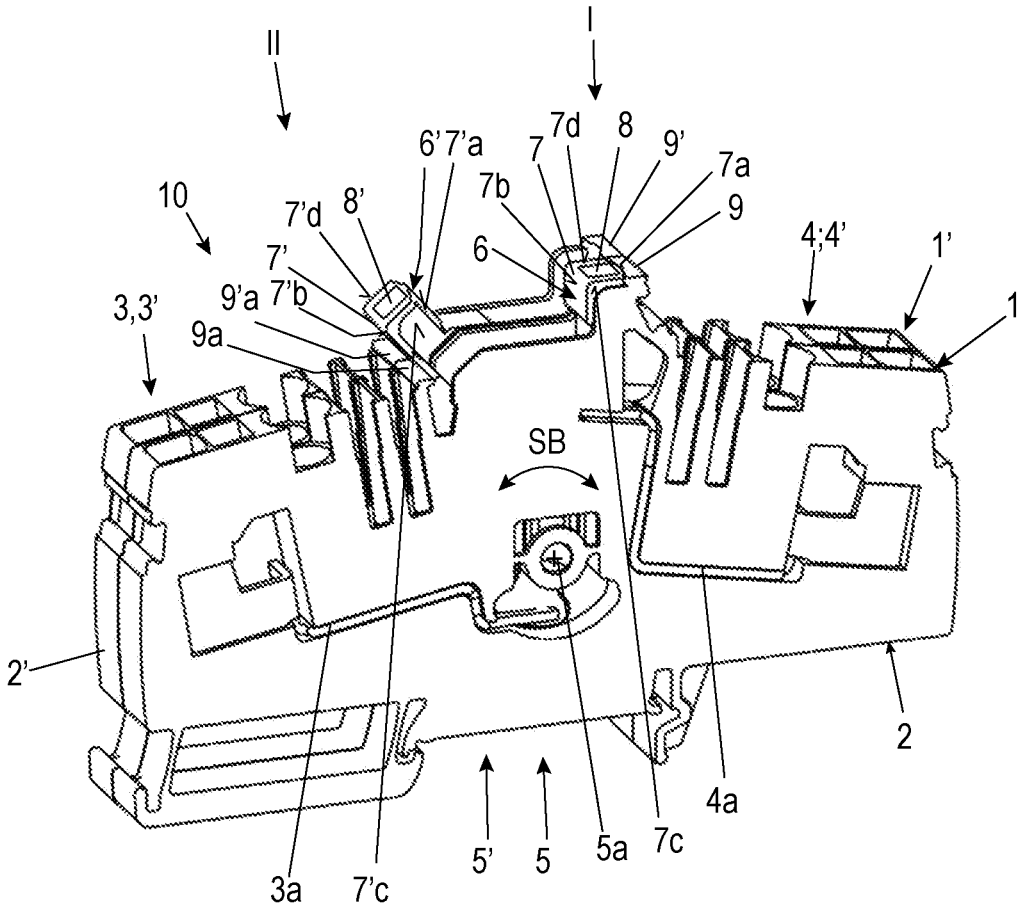
FIG. 1 is a perspective view of conventional disconnect terminals.

FIG. 1 is a perspective view of a conventional disconnect terminal 1 in an assembly 10, which includes two disconnect terminals 1, 1' (of course, there can also be more than two disconnect terminals 1, 1').

To differentiate the two disconnect terminals 1, 1', the reference sign of the disconnect terminal 1' arranged at the rear in the figures, including the reference signs of the individual parts/sections thereof, are respectively identified hereinafter with an apostrophe. Different features of front and rear disconnect terminal 1, 1' are shown separately in the description.

Such disconnect terminals 1, 1' are also referred to as extendable disconnect terminals 1, 1', measurement disconnect terminals, or series disconnect terminals.

The disconnect terminal 1, 1' includes a housing 2, 2' having a first terminal section 3, 3', a second terminal section 4, 4', and a separation section 5, 5' arranged in the middle in between.

A first clamping section (not described in greater detail) for connecting an electrically conductive line (not shown) is arranged in the first connection section 3, 3'. The first clamping section is connected to a first conductor rail 3*a*, which extends into the separation section 5 with a connecting section (not identified).

In a similar manner, a second clamping section (not described in greater detail) for connecting a further electrically conductive line (not shown) is arranged in the second terminal section 4, 4' in a mirror-image to the first terminal section 3, 3'. The second clamping section is connected to a second conductor rail 4*a*, which extends into the separation section 5, 5' with a connecting section (not identified).

The connecting sections of the conductor rails 3*a* and 4*a* are operatively connected to a switching device (not shown) in the separation section 5, 5'. The switching device includes a switching lever 6, 6', which is adjustable from a first switch position I into a second switch position II and back. The switching lever 6, 6' pivots in a switching movement SB around a pivot axis 5*a*.

The pivot axis 5*a* extends perpendicularly to the lateral surfaces (not shown) of the housing 2, 2' of the disconnect terminal 1, 1'.

In the first switch position I, which is also referred to as the connected position, the switching device connects the two connecting sections and thus the first conductor rail 3*a* and the second conductor rail 4*a* in an electrically conductive manner, so that the first clamping section is connected in an electrically conductive manner to the second clamping section. The upper region of the switching lever 6 abuts a stop section 9 of the housing 2 with an actuating section 7 as shown in FIG. 1 for the front disconnect terminal 1.

In the second switch position II, which is also called the separated position, the two connecting sections are separated and isolated from one another, i.e., the electrically conductive connection of the two connecting sections and thus of the conductor rails 3*a* and 4*a* is eliminated or separated, wherein the conductor rail 3'*a* is still electrically connected to the switching lever 6' here.

In this second switch position II, the actuating section 7' of the switching lever 6' abuts a further stop section 9'*a* of the housing 2, as shown in FIG. 1 for the rear disconnect terminal 1'. Furthermore, in the switch position II, a cross bridge (not shown in greater detail) is contacted in such a way that in the case of the switch position II, the terminals 3, 3' of all disconnect terminals located adjacent to one another are accordingly conductively connected to one another/short-circuited via this cross bridge. The cross bridge is provided with similar contacts as the conductor rails 3*a*, 4*a* toward the switching lever.

In the example shown in FIG. 1, a receptacle 8, 8' is indented in the actuating section 7, 7' from above in the radial direction with respect to the pivot axis 5*a*.

The switching lever 6, 6' is actuated manually and/or using a suitable tool here, for example, a screwdriver engaged with the receptacle 8, 8'.

The actuating section 7, 7' of the switching lever 6, 6' includes two opposing face sections in each case. First, there are end face sections 7*a*, 7'*a*, which face toward the terminal sections 4, 4' of the switch position I. There are end face sections 7*b*, 7'*b* opposite thereto, which face toward the terminal sections 3, 3' of the switch position II. Face sections 7*c*, 7'*c*, are located perpendicularly thereto, the surfaces of which extend perpendicularly to the pivot axis 5*a*. And respective face sections 7*d*, 7'*d* are opposite thereto.

Figure 2:
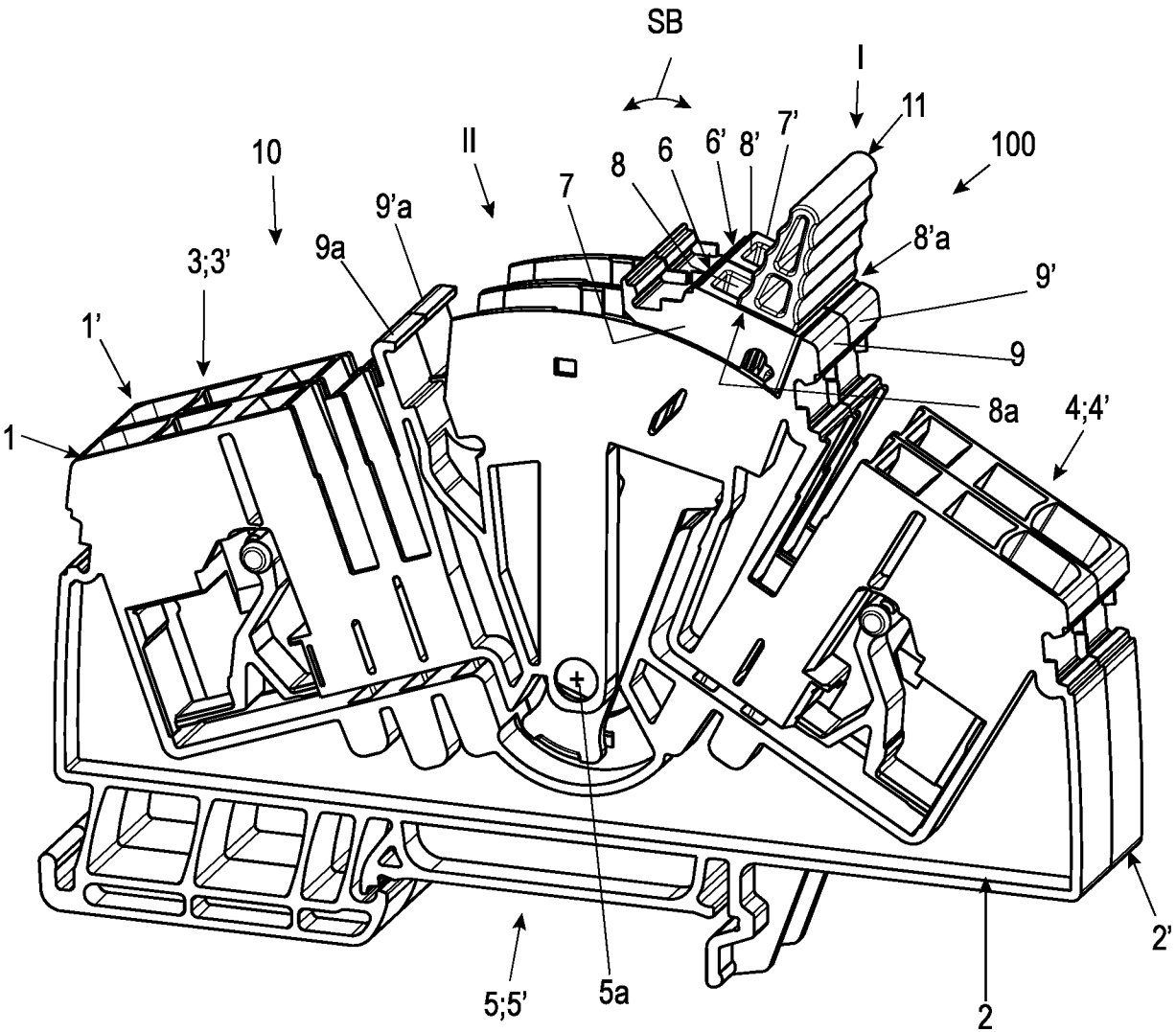
FIG. 2 is a perspective view of a first exemplary embodiment of a disconnect terminal according to the invention having a coupling device according to the invention.

FIG. 2 is a perspective view of a first embodiment of a disconnect terminal 1, 1' according to the invention having a coupling device 100 according to the invention; The assembly 10 includes two adjacent disconnect terminals 1, 1'.

The coupling device 100 is used to couple at least two adjacent switching levers 6, 6' of two adjacent disconnect terminals 1, 1'.

The term "coupling" is to be understood to mean that at least two adjacent switching levers 6, 6' are locked to one another and/or connected so that they are adjustable jointly from the switch position I into the switch position II and back. When the "coupling" is eliminated, the switching levers 6, 6' are separated from one another again and are actuatable independently of one another.

In the conventional disconnect terminal 1, 1' shown in FIG. 1, a type of bracket plug having two plug pins is plugged into the receptacles 8, 8' of the switching levers 6, 6' of the disconnect terminals 1, 1'. The two switching levers 6, 6' can be connected and adjusted jointly by this bracket plug. A separate adjustment of the switching levers 6, 6' independently of one another is only possible if the bracket plug is removed again.

In contrast thereto, the coupling device 100 of the embodiment according to FIG. 2 includes a switchable or adjustable coupling element 11, which couples two switching levers 6, 6' to one another as shown, but can also be embodied for more than two switching levers 6, 6', as is easily conceivable.

The term "switchable" is to be understood as an adjustment of the respective coupling element 11, 18, 22 of the coupling device 100 from a first position into a second position and back. This adjustment can take place rotationally and/or linearly.

Furthermore, it is conceivable, but not explained in greater detail, that there can be further switch positions/mechanisms, which can effectuate, for example, a coupling of a middle disconnect terminal to disconnect terminals arranged on the left or right adjacent thereto. This is not shown but is easily conceivable.

In the actuating sections 7, 7' of the switching levers 6, 6', two adjacent receptacles 8, 8*a* and 8', 8'*a* are formed in each case in the circumferential direction with respect to the pivot axis 5*a*. The receptacles 8*a*, 8'*a* are used to accommodate the coupling element 11 and are arranged between the receptacles 8, 8' and end face sections 7*a*, 7'*a* of the actuating section 7, 7'.

The end face sections 7*a*, 7'*a* are each in contact with a stop 9, 9' of the housing 2, 2' in the switch position I. In the switch position II, further end face sections 7*b*, 7'*b* of the actuating sections 7, 7' of the shift levers 6, 6' are each in contact with the further stop 9*a*, 9'*a* of the housing 2, 2'.

The coupling element 11 is inserted into one of the switching levers 6, 6' and is held captively in this position by engaging behind it. Furthermore, the coupling element 11 is displaceably guided in this switching lever 6, 6' and can be switched from a first coupling position A into a second coupling position B (see FIGS. 4, 6, 7). This is explained in greater detail hereinafter.

FIGS. 3-9 are partial perspective views of the coupling device 100 according to FIG. 2 in various coupling positions A, B and switch positions I, II.

Figure 3:
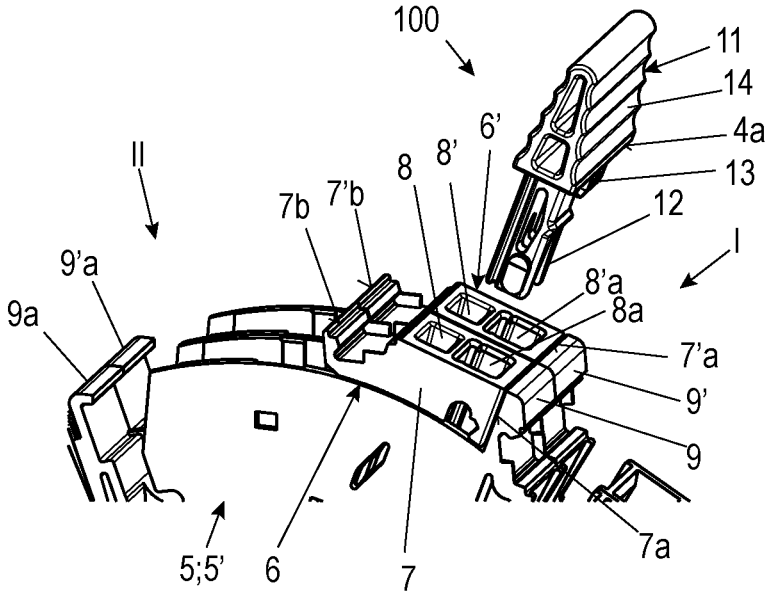
FIGS. 3-9 are partial perspective views, respectively, of the coupling device according to FIG. 2 in various coupling positions and switch positions.

In FIG. 3, the coupling element 11 is shown before the insertion into the receptacles 8, 8' of the switching levers 6, 6' in a so-called pre-installation position. The switching levers 6, 6' both abut the stop sections 9, 9' of the respective housing 2, 2' in switch position I.

The coupling element 11 includes a switch pin 12, a driver 13 and a handle 14. The switch pin 12 and the driver 13 are attached to a lower side 4*a* of the handle 14. A length of the switch pin 12 is more than twice as long as a length of the driver 13. The switch pin 12 and the driver 13 are arranged adjacent with respect to the pivot axis 5*a*.

Figure 4:
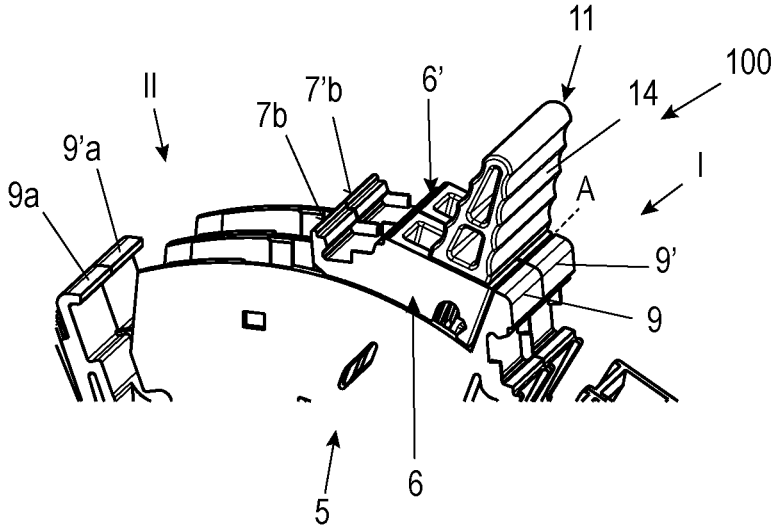
Figure 5:
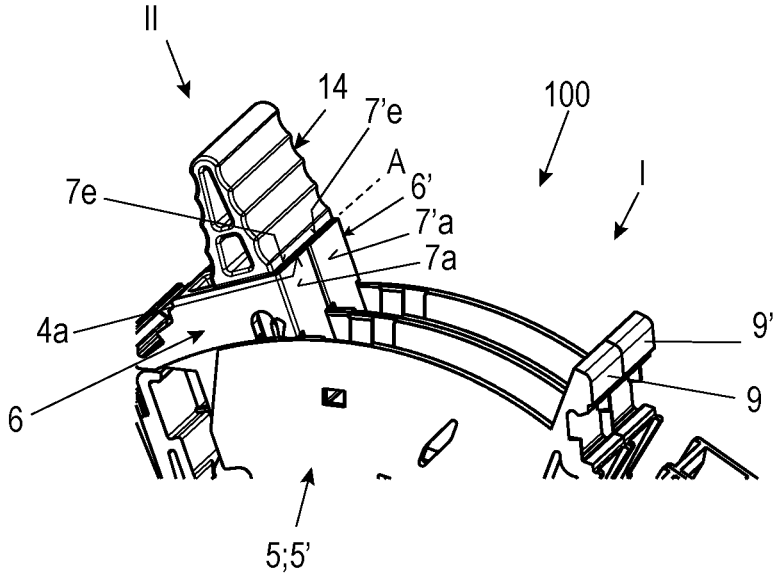

FIG. 4 shows the disconnect terminals 1, 1' having the switching levers 6, 6' and the coupling device 100 in the switch position I, wherein the switch position II is shown in FIG. 5.

The coupling element 11 is inserted into the receptacles 8*a*, 8'*a* of the actuating sections 7, 7' of the switching levers 6, 6' linearly in the radial direction with respect to the pivot axis 5*a*, so that the long switch pin 12 is accommodated in the receptacle 8*a* of the switching lever 6 of the front disconnect terminal 1 shown in FIGS. 2 to 9 and the short driver 13 is accommodated in or engaged with the receptacle 8'*a* of the switching lever 6' of the rear disconnect terminal 1' shown in FIGS. 2 to 9. The lower side 4*a* of the handle 14 of the coupling element 11 rests on surfaces 7*e*, 7'*e* of the actuating sections 7, 7' in this case. This position of the coupling element 11 corresponds to the first coupling position A (FIG. 4), in which a coupling, which is also referred to as a lock, of the switching levers 6, 6' is (mechanically) switched on.

In this way, the switching levers 6, 6' are coupled in the first coupling position A by the coupling element 11 in such a way that both switching levers 6, 6' can be adjusted simultaneously by manual actuation by the handle 14 of the coupling element 11 using this in the switching movement SB (FIG. 2) from the switch position I into the switch position II and back. Of course, the adjustment can also be carried out by a tool, preferably a screwdriver, which is inserted into one of the receptacles 8, 8' of the actuating sections 7, 7' of the switching levers 6, 6'.

Figure 6:
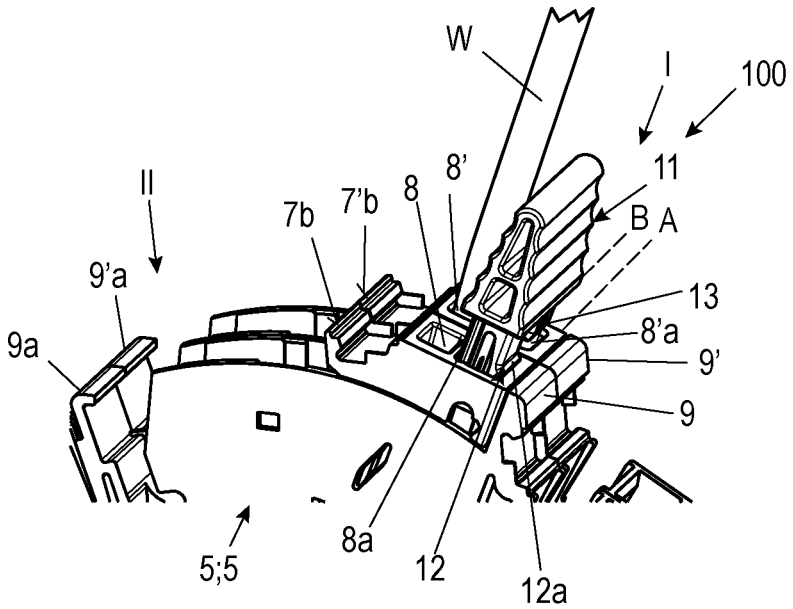

FIG. 6 shows the second coupling position B of the coupling element 11 of the coupling device 100 in the first switch position I.

In the second coupling position B, the coupling element 11 is adjusted by a switching stroke travel SH radially in the receptacle 8*a* of the actuating section 7 of the front switching lever 6 out of the first coupling position A. The second coupling position B is thus switched on.

In the second coupling position B, the driver 13 of the coupling element 11 is completely moved out of its receptacle 8'*a* of the actuating section 7' of the rear switching lever 6', whereby the coupling between the shift levers 6, 6' is eliminated. In other words, the driver 13 is disengaged from the receptacle 8'*a* in the second coupling position B.

In this way, the coupling element 11 is switchable or adjustable linearly in the radial direction with respect to the pivot axis 5*a*.

Figure 7:
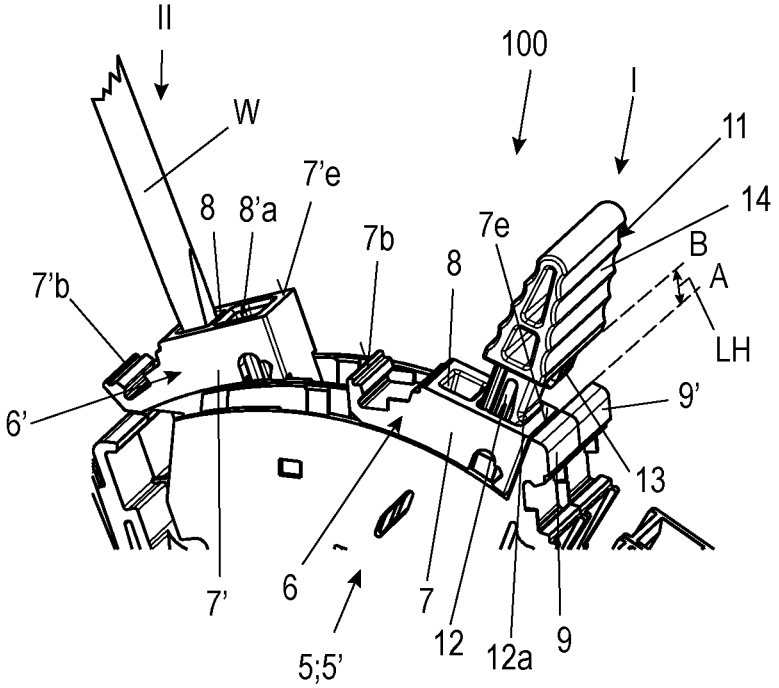

Thus, for example, the rear switching lever 6' can be adjusted by a tool W, preferably a screwdriver, which is inserted into the receptacle 8', independently of the front switching lever 6 into the switch position II shown in FIG. 7.

Figure 8:
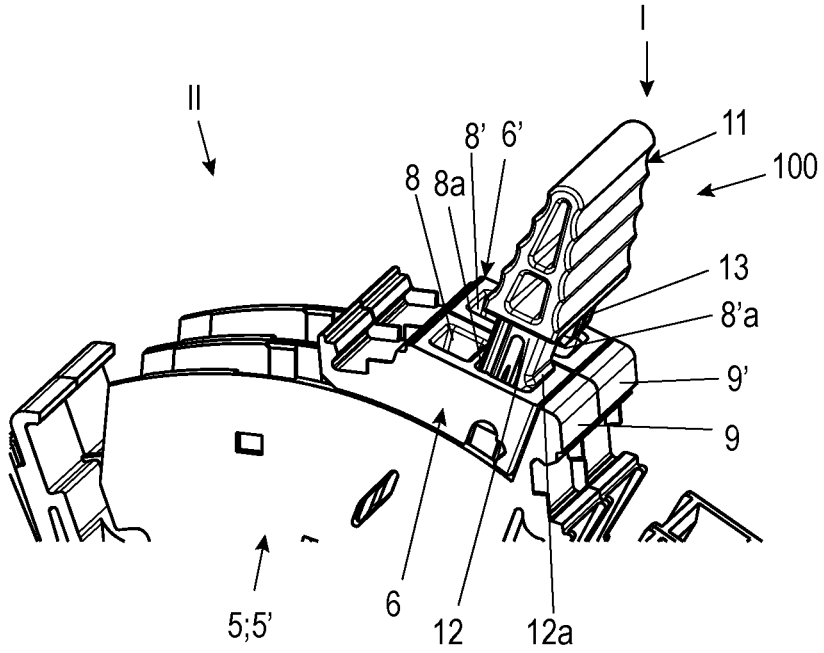
Figure 9:
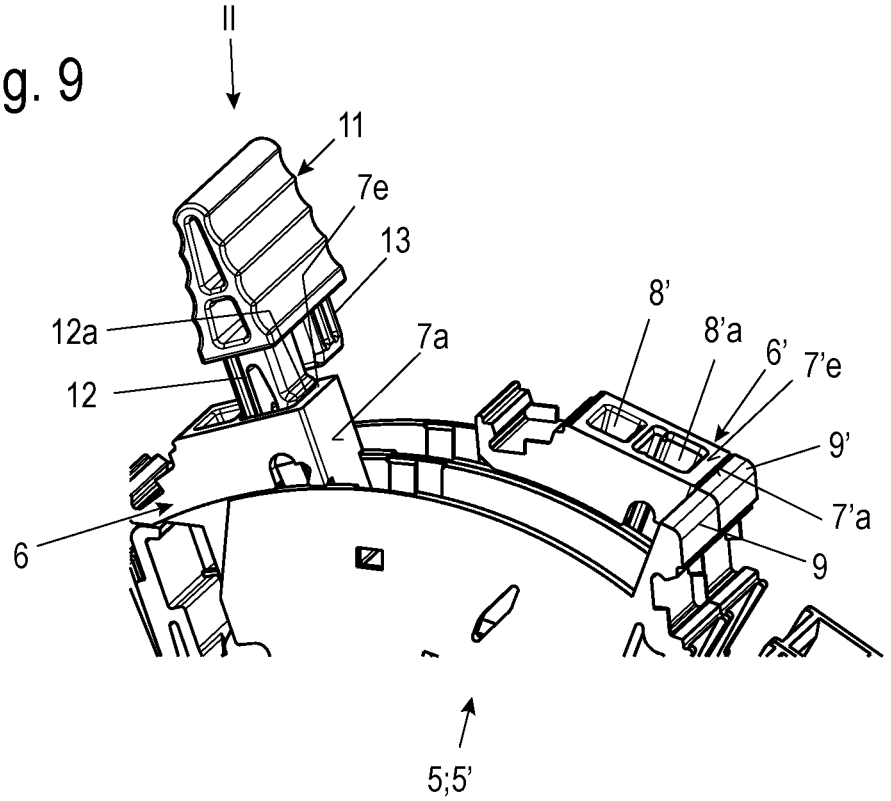

Similarly, the front switching lever 6 can be adjusted by manual actuation (or also by a tool) of the handle 14 of the coupling element 11 independently of the rear switching lever 6' from the switch position I shown in FIG. 8 into the switch position II shown in FIG. 9.

The coupling element 11 is fixed by the switch pin 12 in the associated receptacle 8 in the first coupling position A and in the second coupling position B by a detent mechanism in each case. This is described hereinafter in greater detail in conjunction with FIGS. 10 to 13.

Figure 10:
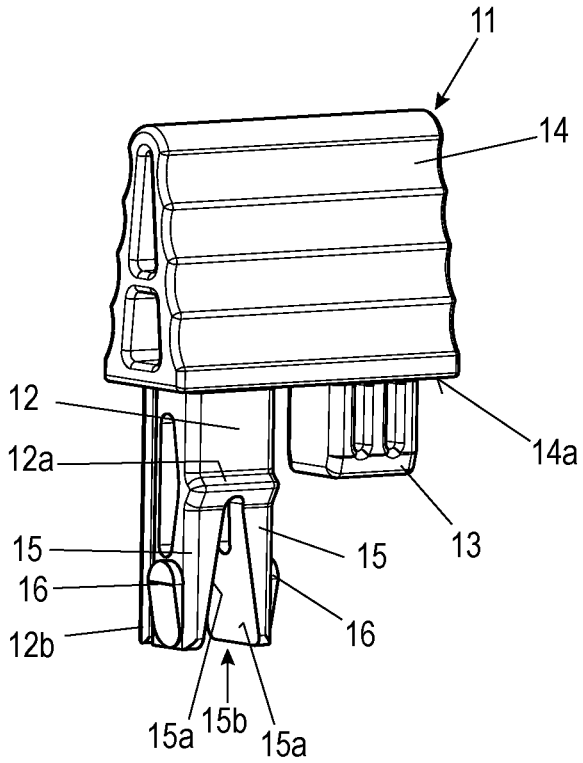
FIGS. 10-10*b* are two perspective and one plan view, respectively, of a coupling element of the coupling device of the first exemplary embodiment of the disconnect terminal according to the invention according to FIG. 2.
Figure 10A:
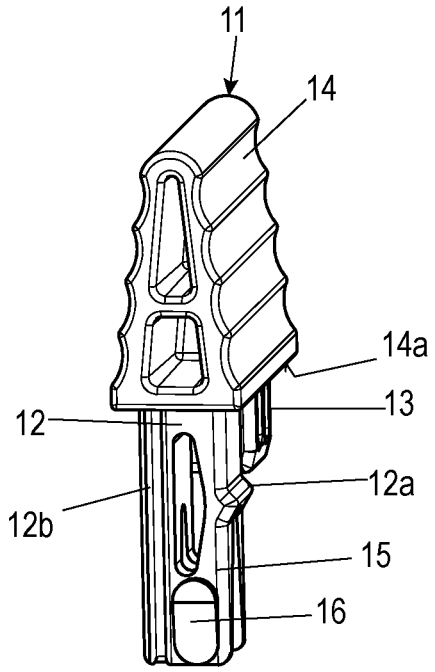

FIGS. 10, 10*a* ad 10*b* show the coupling element 11 of the coupling device 100 of the first embodiment of the disconnect terminal 1, 1' according to the invention according to FIG. 2.

The switch pin 12 of the coupling element 11 includes a lug 12*a* and at least one detent spring 15 having a detent lug 16 as a detent mechanism. The lug 12*a* is formed on the switch pin 12 in a strip shape at a distance of approximately one third of the length of the switch pin 12 from the lower side 14*a* of the handle 14, faces toward the associated stop section 9*d* in the installed state, and extends in parallel to an edge of the lower side 14*a* of the handle 14 and in parallel to the pivot axis 5*a* in the installed state of the coupling element 11.

Two opposing detent springs 15 are provided approximately in the lower third of the switch pin 12, on the outer side of each of which an outwardly protruding detent lug 16 is formed in a lower region. The detent lugs 16 protrude in a width direction of the handle 14, wherein the width direction extends in the direction of the pivot axis 5*a* in the installed state of the coupling element 11.

Each detent spring 15 tapers in its course in the direction of the longitudinal axis of the switch pin 12 towards its respective free end in such a way that a wedge-shaped intermediate space 15*b* is formed between inner surfaces 15*a* of the detent springs 15. A U-shaped recess (not shown), which extends essentially in parallel to the extension direction (see FIG. 15*a*) is located behind this.

An expanding section 7*f* can be accommodated in this wedge-shaped intermediate space 15*b* and/or in this U-shaped recess. The expanding section 7*f* can be arranged in the receptacle 8*a* and interacts with the inner surfaces 15*a* and/or with the U-shaped recess in such a way that it pushes the detent springs 15 with the detent lugs 16 outward if the switch pin 12 is inserted into the receptacle 8*a* during the insertion of the coupling element 11. This has the advantage that a retention effect of the detent lugs 16 is reinforced. This is also explained in conjunction with FIGS. 11*a* and 11*b*.

Furthermore, starting from the lower side 14*a* of the handle 14, a guide web 12*b* extending over the entire length of the switch pin 12 and the respective detent spring 15 is formed on the switch pin 12. In the example shown, two opposing guide webs 12*b* are provided.

The driver 13 also includes two opposing guide webs 13*a*, which extend over the entire length of the driver on two opposing longitudinal sides of the driver 13.

The handle 14 includes an arrow as a symbol 14*b*, which points downward toward the switching levers 6, 6' and thus indicates the plugging direction of the coupling element 11 in the direction toward the first coupling position A.

Using this principle, independent switching of adjacent switching levers 6, 6' is possible from almost any position. The exception is when both switching levers 6, 6' are in the second switch position II and the coupling element 11 is in the coupling position B. The switching lever 6' located in the rear in FIGS. 2-9 then cannot be moved without displacing/adjusting the front switching lever 6.

Figures 11, 11A, 11B:
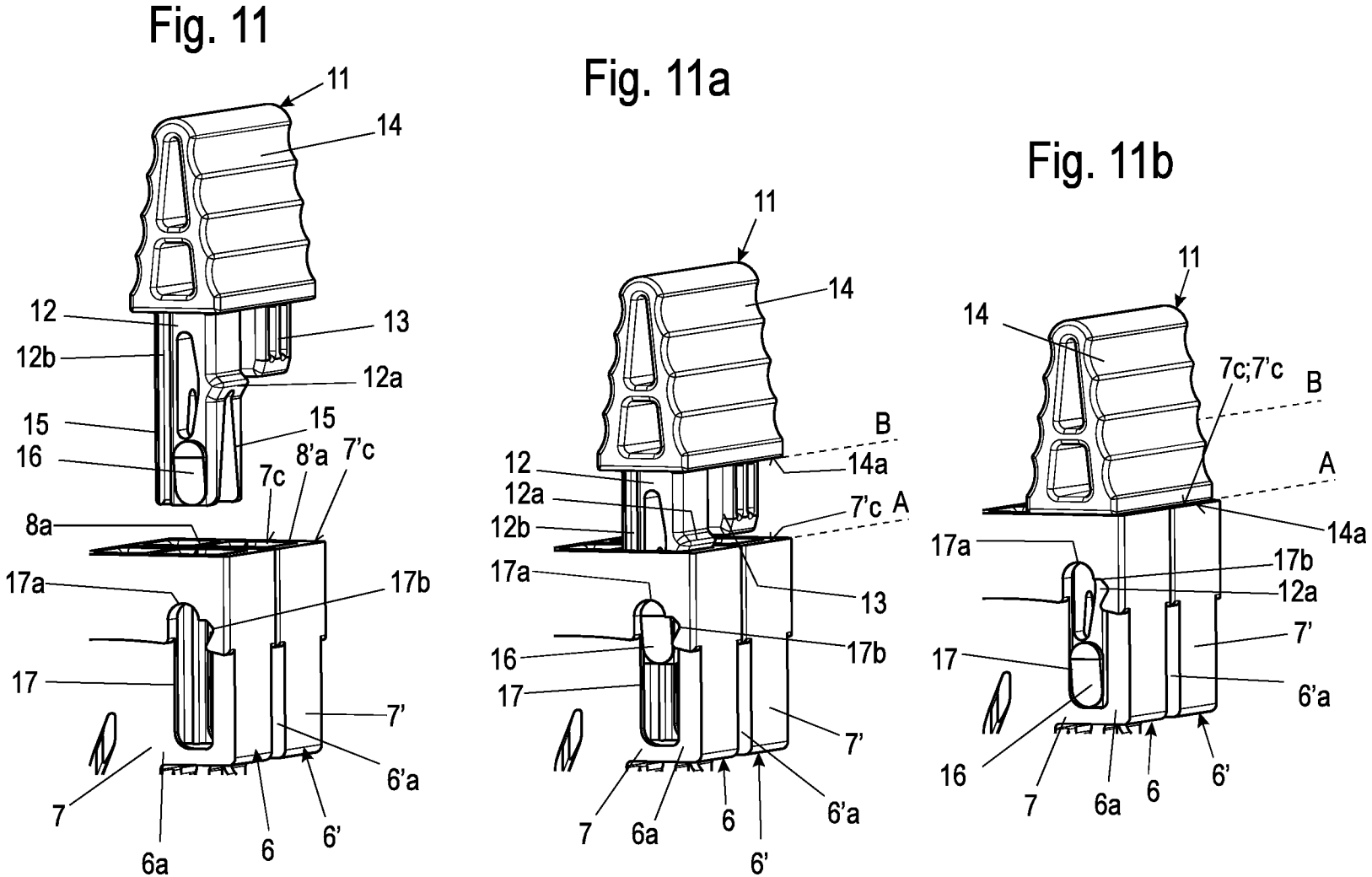
FIGS. 11-11*b* are perspective views of the coupling device of the first exemplary embodiment of the disconnect terminals according to the invention according to FIG. 2 in various coupling positions, respectively.

FIGS. 11, 11*a* and 11*b* show the coupling device 100 of the first embodiment of the disconnect terminals 1, 1' according to the invention according to FIG. 2 in various coupling positions.

A guide recess 17 is indented in each of the opposing side walls 6*a* of the switching lever 6 (and also of the switching lever 6', which is not shown but is easily conceivable) in the respective actuating section 7, 7'. The guide recess 17 is a type of oblong hole and forms a lateral opening of the receptacle 8*a*, 8'*a* having an upper retaining section 17*a* and a lateral retaining section 17*b*. The upper retaining section 17*a* is formed from the upper rounding of the guide recess 17. The lateral retaining section 17*b* is introduced laterally approximately in a semicircle approximately in the upper fourth of the guide recess 17.

When the coupling element 11 having the switch pin 12 is inserted having its detent springs 15 in front into the receptacle 8*a* of the switching lever 6, the detent springs 15 are firstly compressed toward one another. Upon further insertion, the detent lugs 16 are pressed outward into the guide recesses 17 again by the pretensioned detent springs 12 with assistance of an expanding locking web 7*g*, 7'*g* (see FIG. 12), corresponding to the expanding web 7*f*, located in the receptacle 8*a*.

In the second coupling position B (FIG. 11*a*), the detent lugs 16 are then in formfitting contact with the upper retaining sections 17*a* of the guide recess 17, wherein the lug 12*a* of the switch pin 12 simultaneously rests on the surface 7*e* of the switching lever 6.

In this way, the coupling element 11 is fixed in its longitudinal movement option in the second coupling position B, in that the detent lugs 16 in conjunction with the upper retaining sections 17*a* of the guide recess 17 prevent withdrawal of the coupling element 11 (using a defined force located below the destruction limit) and the lug 12*a* also opposes pushing in of the coupling element 11 with a defined retaining force. In this way, the detent lugs 16 additionally form a captivity function of the coupling element 11.

Figure 10B:
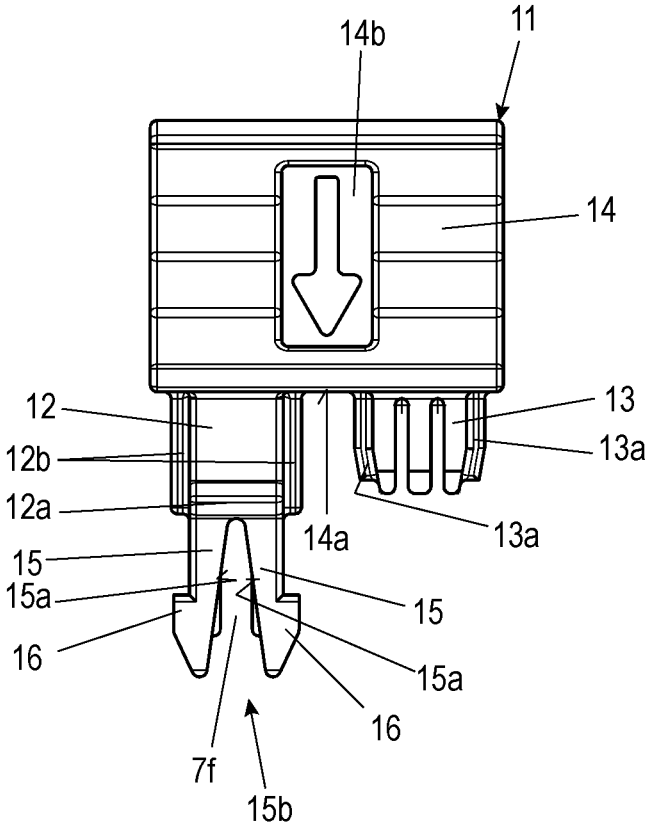

Strengthening of the retaining force of the detent lugs 16 can be reinforced by the above-described expanding section 7*f* (see FIG. 10*b*). The captivity function is thus enhanced.

To assume the first coupling position A, the retaining force of the lug 12*a* has to be overcome. Further pushing of the switch pin 12 of the coupling element 11 into the receptacle 8*a* is then possible, until the lug 12*a* engages with the lateral retaining sections 17*b* of the guide receptacles 17 and in this manner fixes and maintains the first coupling position A of the coupling element A. This is illustrated in FIG. 11*b*.

Figure 12:
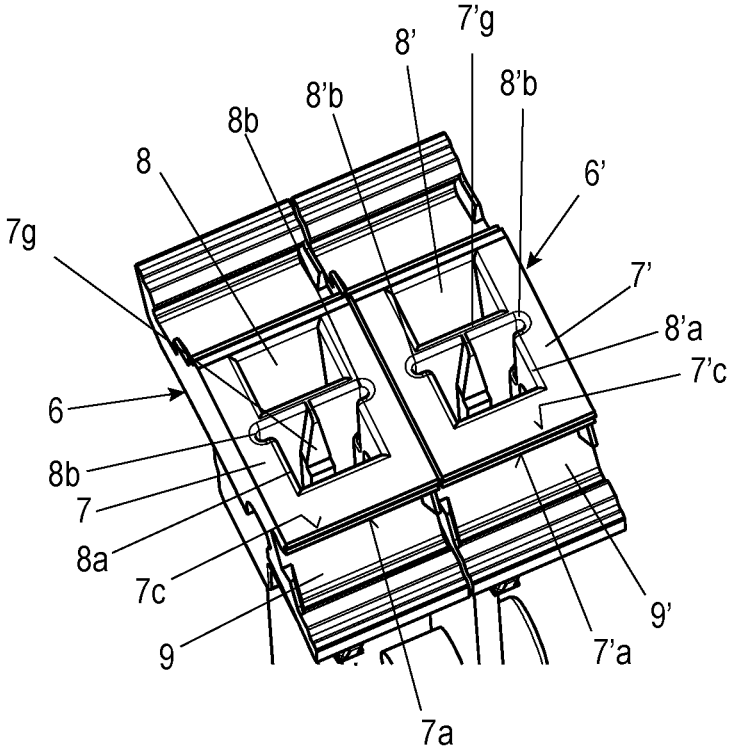
FIGS. 12 and 13 are top perspective views, respectively, of actuating sections of disconnect terminals according to the first exemplary embodiment according to FIG. 2
Figure 13:
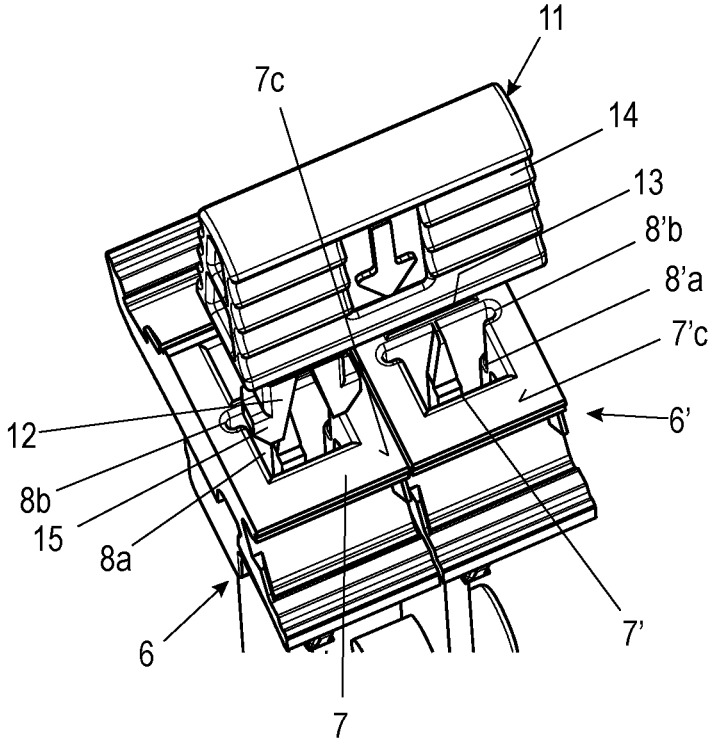

FIGS. 12 and 13 are top views of the actuating sections 8, 8'; 8*a*, 8' of the disconnect terminals according to the first exemplary embodiment according to FIG. 2.

In the transition regions between the successive receptacles 8 and 8*a* and 8' and 8'*a*, two opposing guide grooves 8*b*, 8'*b* are each shaped into the sides of the receptacles 8' and 8'*a*. These guide grooves 8*b*, 8'*b* each extend over the entire length of a respective receptacle 8', 8'*a*.

The guide grooves 8*b* correspond to the guide webs 12*b* of the switch pin 12 and are engaged with them when the coupling element 11 is inserted into the receptacle. In the same way, the guide grooves 8' b correspond to the guide webs 13*a* of the driver 13 and are also engaged with them. The guide grooves 8*b*, 8'*b* and guide webs 12*b*, 13*a* moreover form a confusion-free insertion of the coupling element 11 into the receptacles 8*a*, 8'*a*. This is apparent from FIG. 13

Figure 14:
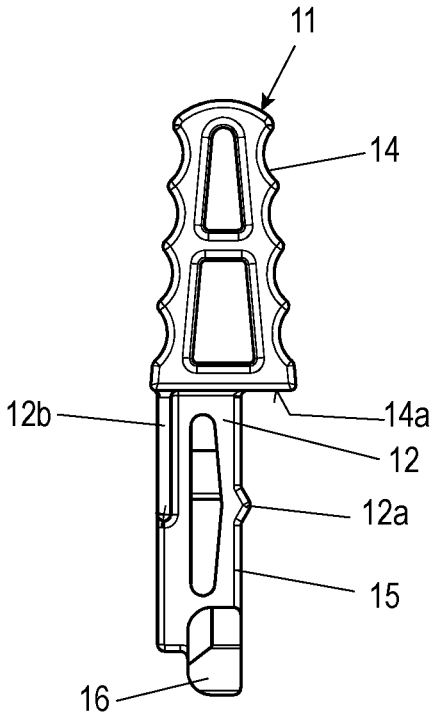
FIGS. 14 and 14*a* are plan views of a variant of the coupling elements according to FIGS. 10-10*b*, respectively.
Figure 14A:
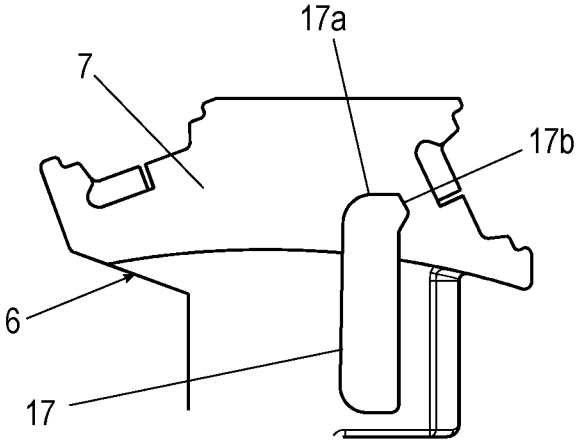
Figure 15:
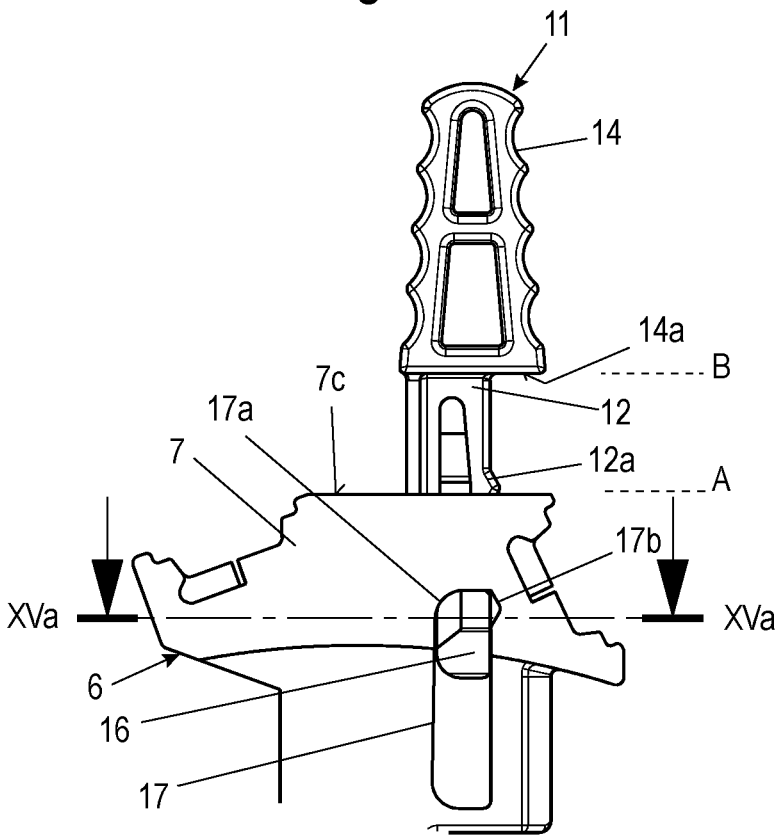
FIG. 15 is a plan view of the coupling elements of FIGS. 14 and 14*a* in an initial coupling position.
Figure 16:
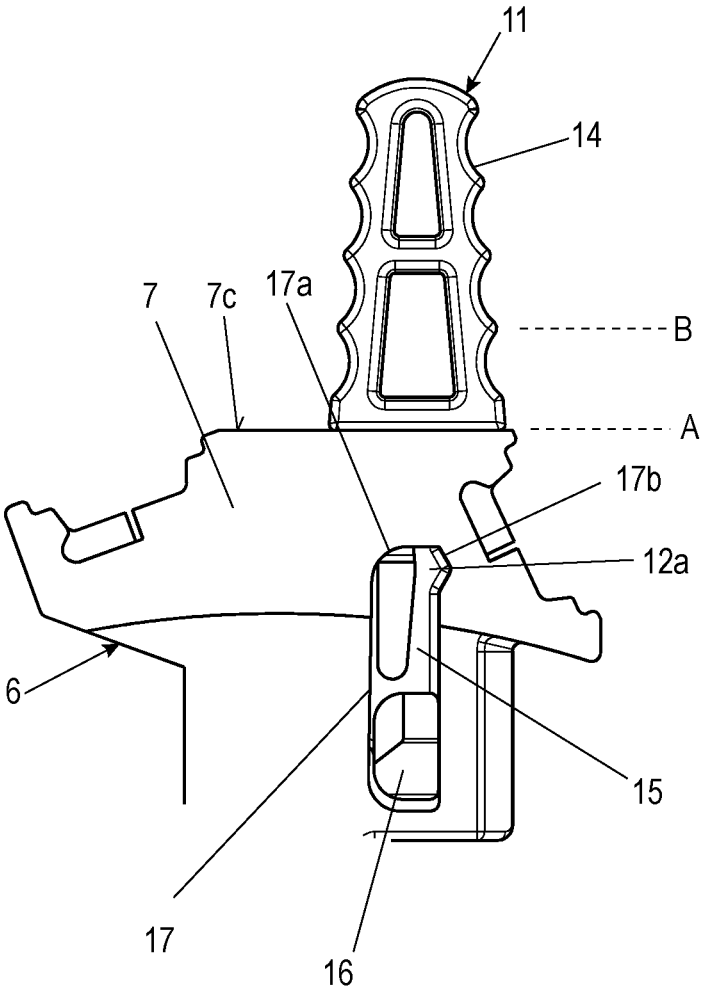
FIG. 16 is a plan view of the coupling elements of FIGS. 14 and 14*a* in a final coupling position.

FIGS. 14-16 show the coupling element 11 according to FIGS. 10-10*b* in various coupling positions;

FIG. 14, like FIG. 11, shows the coupling element 11 before the insertion. The second coupling position B is shown similarly in FIG. 15 as in FIG. 11*a*. FIG. 16 illustrates the first coupling position A like FIG. 11*b*.

In this variant, the guide webs 12*b* only extend over half of the length of the switch pin 12. The detent lugs 16 are formed laterally on the free ends of the detent springs 12. The retaining sections 17*a* and 17*b* of the guide recesses 17 merge into one another.

In the second coupling position B, which is shown in FIG. 15, the detent lug 16 is in formfitting contact with the upper retaining section 17*a* of the guide recess 17. This is also the case on the other side of the switching lever 6, which is not shown but is easily conceivable.

Figure 15A:
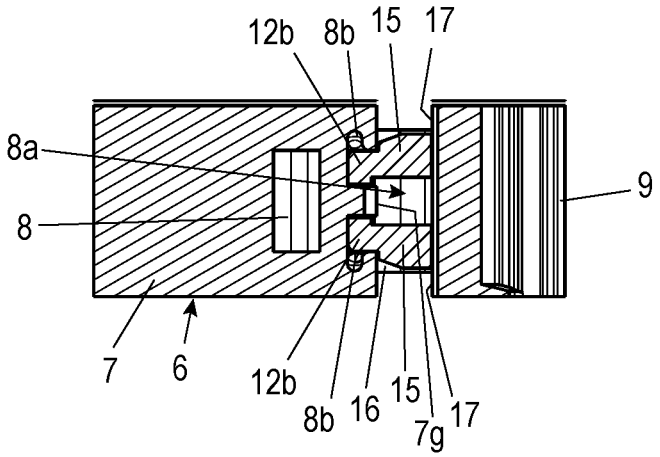
FIG. 15*a* is a sectional view of one of the coupling elements of FIG. 15.

FIG. 15*a* shows a cross-sectional view through the actuating section 7 of the switching lever 6 in the second coupling position B of the coupling element 11. The guide webs 12*b* are linearly guided in the guide grooves 8*b*. The expanding locking web 7*g* is engaged and shows that in coupling position B, the detent springs 15, which are also referred to as spring legs, cannot deflect.

In the first coupling position A, the lug 12*a* is not only engaged with the lateral retaining section 17*b* of the guide recess 17, but rather the lug 12*a* is also in contact with the upper retaining section 17*a* of the guide recess.

In the examples shown, the switching or adjusting or moving direction of the coupling element 11 is linear in the radial direction with respect to the pivot axis 5*a*. The switching/adjusting/moving direction can also extend rotationally or in another trajectory. However, this takes place in a different direction than the direction in which the actuating movement of the switching lever 6, 6' extends around the pivot axis 5*a*, for example, along another trajectory is also conceivable.

The coupling element 11 is shown in the preceding examples having the switch pin 12 inserted into the switching lever 6 of the front disconnect terminal 1. Of course, the coupling element 11 can also be inserted rotated by 180°, wherein the switch pin 12 is inserted into the receptacle 8'*a* of the rear disconnect terminal 1' and the driver 13 is inserted into the receptacle 8*a* of the front disconnect terminal 1. In this manner, the switching levers 6, 6' can be switched on alternately to one another.

It is not shown, but it is conceivable that the coupling element 11 includes one switch pin 12 and two or more drivers 13. These drivers 13 can be arranged on one side to the right or left of the switch pin 12 or on both sides distributed evenly or unevenly. In this way, the switching levers 6, 6' can be additionally connected by, for example, three or four or more disconnect terminals 1, 1'.

All or only some of these additional connections can be established in the first coupling position A. Intermediate positions between the first coupling position A and the second coupling position B are possible, in which the switching levers 6, 6' of the further disconnect terminals 1, 1' are connected.

An alternative of the coupling element 11 which is not shown, but is conceivable is that the coupling element 11 includes two pins of equal length, which are inserted into the receptacles of the adjacent switching levers 6, 6' and the handle 14 has a separation (for example, in the middle), which is closed in the connected state of the switching levers 6, 6', i.e., in the first coupling position A. The separation is opened to eliminate the connected state of the switching levers 6, 6', in order to obtain the second coupling position B. The opening takes place in that the separable parts of the handle 14 are pivoted away from one another together with the associated pins in opposing pivot directions around the axes of the respective pins in the respective receptacles of the switching levers 6, 6'. The pins remain in the receptacles of the switching levers in this case. The separation is form-fitting, for example, like two gearwheels or tooth segments which disengage.

In still a further embodiment of the coupling element 11, the switch pin 12 is rotatably attached to the handle 14. This embodiment is not shown but is easily conceivable in conjunction with the figures (for example, FIGS. 6, 11). If the coupling element 11 is located in the second coupling position B, in this embodiment the handle 14 can be pivoted by 180° together with the driver 13 due to the rotatably attached switch pin 12 around the longitudinal axis of the switch pin 12 remaining in the associated receptacle 8*a*. This is advantageous if the arrangement 10 includes, for example, three disconnect terminals 1, 1', in which the disconnect terminal 1 has the receptacle 8*a* into which the coupling element 11 having the switch pin 12 is inserted. In this way, by pivoting the handle 14 with the driver 13 into the second coupling position B, alternately one of the switching levers 6' of the adjacent disconnect terminal 1' can be connected in the first coupling position A, without the coupling element 11 having the switch pin 12 having to be withdrawn completely from the associated receptacle 8*a* and turned over.

Figure 17:
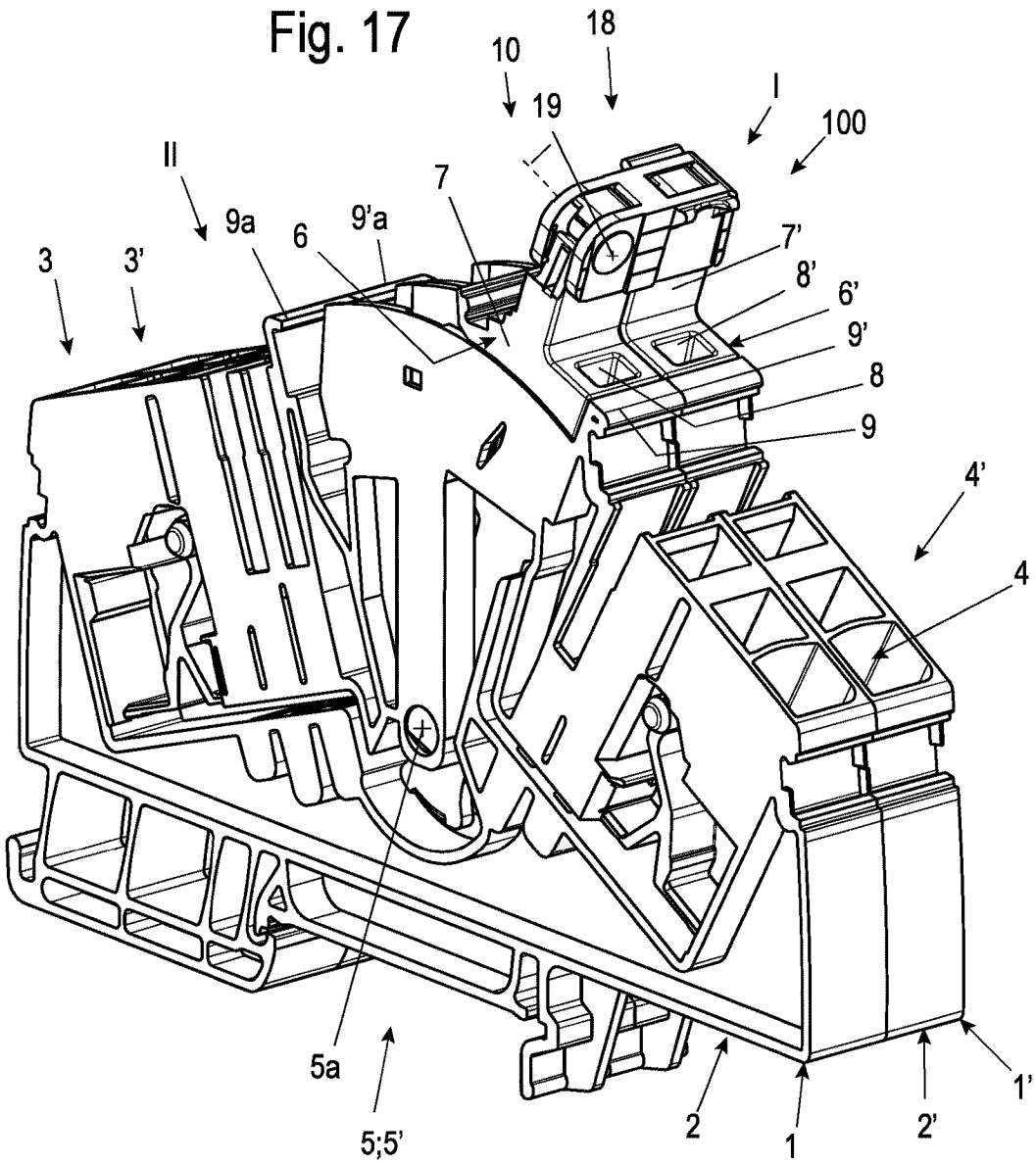
FIG. 17 is a perspective view of a second exemplary embodiment of the disconnect terminal according to FIG. 2 having a coupling device according to the invention.

FIG. 17 shows a second exemplary embodiment of the disconnect terminal 1, 1' according to the invention according to FIG. 2 having a coupling device 100 according to the invention.

The coupling device 100 includes a coupling element 18 pivotable around an axis 19. The pivotable coupling element 18 is also referred to as a switchable rotation locking element.

Furthermore, it is conceivable, but not explained in greater detail, that there can be further switch positions/mechanisms, which can effectuate, for example, a coupling of a middle disconnect terminal 1, 1' to disconnect terminals 1, 1' arranged on the left or right adjacent thereto.

Only the receptacles 8, 8' for an actuating tool are each indented in the actuating sections 7, 7' of the switching levers 6, 6'. One actuating section 7, 7' protrudes radially in each case between the receptacles 8, 8' and the further end face sections 7*b*, 7'*b* of the actuating sections 7, 7' of the switching levers 6, 6'.

The coupling element 18 is pivotable around the axis 19 on the radially protruding actuating section 7 of the switching lever 6 and is held captively thereon. The axis 19 extends perpendicularly to the pivot axis 5*a* of the switching lever 6, 6', wherein the axis 19 is tangential to an imaginary circle having a center point, through which the pivot axis 5*a* of the switching levers 6, 6' extends.

The coupling element 18 can be switched from a first coupling position A into a second coupling position B (see FIGS. 19, 19*a*) by pivoting around the axis 19. This is explained in greater detail hereinafter.

Figure 18:
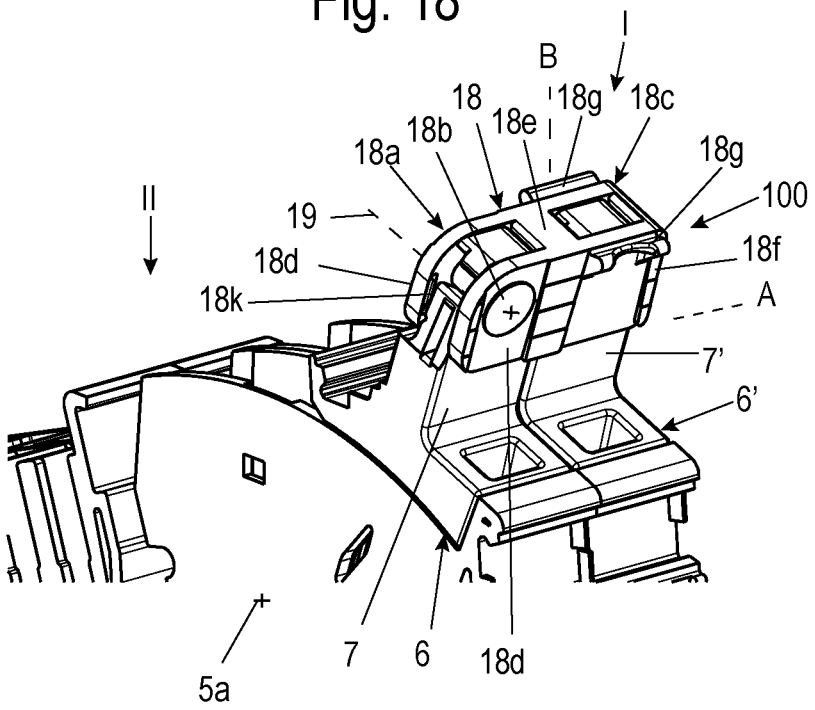
FIGS. 18-21 are partial perspective views of the coupling device of the second exemplary embodiment according to FIG. 17 in various coupling positions and switch positions, respectively.
Figure 18A:
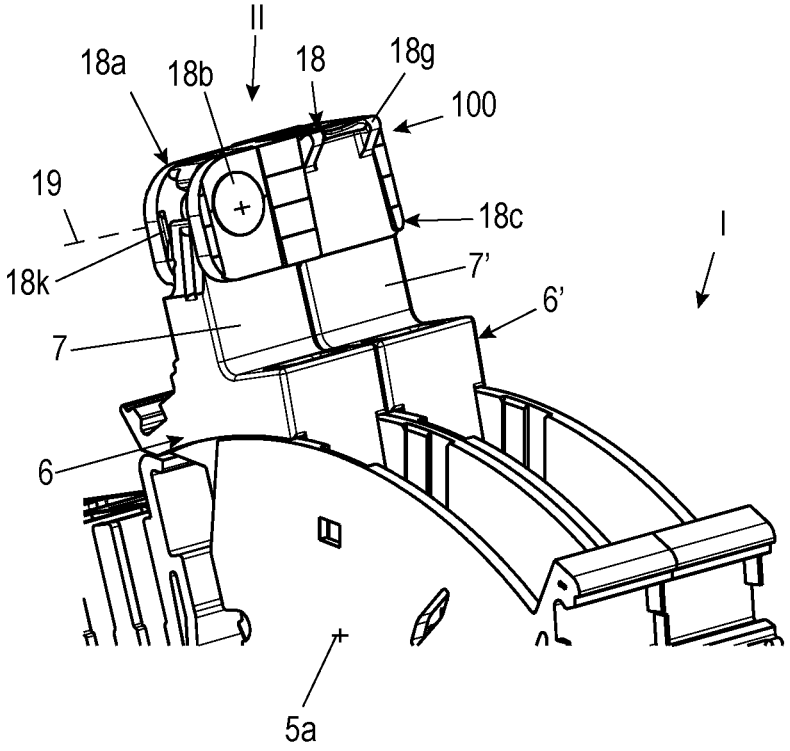

FIGS. 18-21 show the coupling device 100 of the second embodiment according to FIG. 17 in various coupling positions and switch positions;

FIG. 18 shows the switch position I and the switch position II is shown in FIG. 18*a*. The coupling element 18 is in the coupling position A in each case, in which it couples and/or locks the two switching levers 6, 6' to one another.

The coupling element 18 is a kind of oblong hood and includes a pivot section 18*a*, a shaft section 18*b* having the axis 19, and a coupling section 18*c*. The pivot section 18*a* and the coupling section 18*c* are connected by two side walls 18*d* arranged in parallel. The side walls 18*d* are connected centrally on the upper longitudinal sides thereof by a transverse wall 18*e*. In the end region of the coupling section 18*c*, the ends of the side walls 18*d* are connected by a further transverse wall 18*e*.

The pivot section 18*a* is formed from first rounded ends of the side walls 18*d*, between which the shaft section 18*b* is attached.

The shaft section 18*b* includes a disk-shaped solid shaft section 18*i* and a section flattened thereon in the direction of the axis 19. This flattened section is referred to as the key surface 18*j*. The key surface 18*j* here extends in parallel to the lower edges of the side walls 18*d* and faces downward when the coupling element 18 is in the first coupling position A.

The coupling section 18*c* is determined from the second ends of the side walls 18*d* and the transverse wall 18*f*.

The distance of the parallel side walls 18*d* to one another corresponds to a thickness of the actuating sections 7, 7' projecting radially from the switching levers 6, 6' in such a way that the free end regions of the actuating sections 7, 7' can each be accommodated between the side walls 18*d* of the coupling element 18.

The pivot section 18*a* and the coupling section 18*c* thus form two hood sections which are connected to one another.

The shaft section 18*b* of the pivot section 18*a* of the coupling element 18 is pivotably accommodated in a receptacle 20 of the protruding actuating section 7. This is explained in greater detail hereinafter. An internal diameter of the receptacle 20, 20' corresponds to an external diameter of the disk-shaped solid shaft section 18*i* of the shaft section 18. In this way, the coupling element 18 is pivotably attached to the protruding actuating section 7.

In the first coupling position A, which is shown in FIGS. 17, 18, and 18*a*, the coupling element 18 is pivoted via the radially protruding actuating section 7' of the adjacent switching lever 6' and is coupled thereto in a formfitting manner. The coupling section 18*c* encloses the radially protruding actuating section 7' of the adjacent switching lever 6' like a hood. A longitudinal axis of the coupling element 14 extends in the first coupling position A in parallel to the pivot axis 5*a* of the switching lever 6, 6'. At the same time, the coupling section 18*c* is fixed in the coupling position A to the radially protruding actuating section 7' using a detent device, which will be described hereinafter.

Lever overhangs 18*g* are formed on each of the upper end regions of the side walls 18*d* of the coupling section 18*c*. By the lever overhangs 18*g* as handle sections, the coupling element 18 can be pivoted manually from the first coupling position A into the second coupling position B by lifting the coupling section 18*c* and pivoting the coupling element 18 around the shaft section 18*b* and its axis 19. A pivot angle between the two coupling positions A and B is 90°.

In the second coupling position B, the coupling element 18 or its longitudinal axis is perpendicular to the actuating section 7 of the switching lever 6 and radial with respect to the pivot axis 5*a*. The coupling element 18 is retained in this second coupling position B by a detent device or a detent mechanism, which will be explained in greater detail hereinafter.

Figure 19:
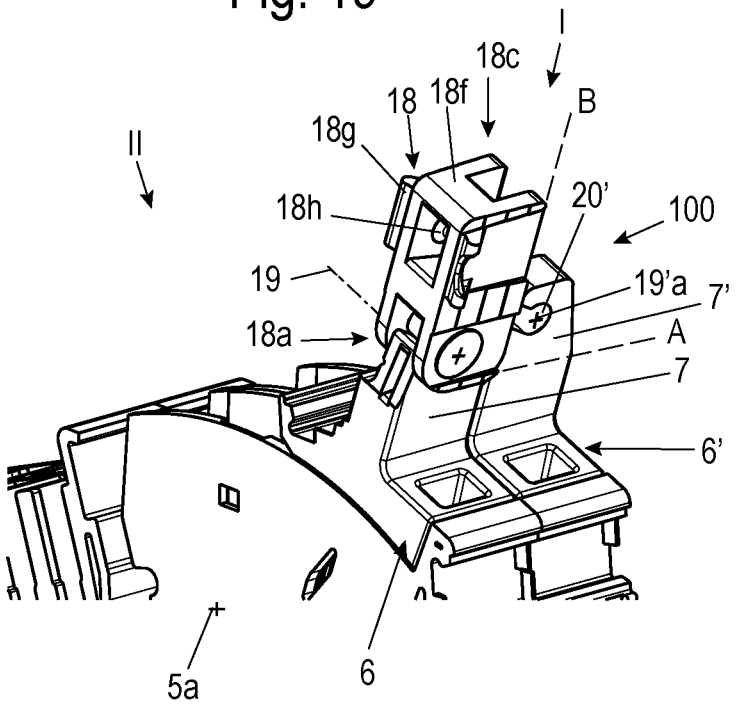
Figure 19A:
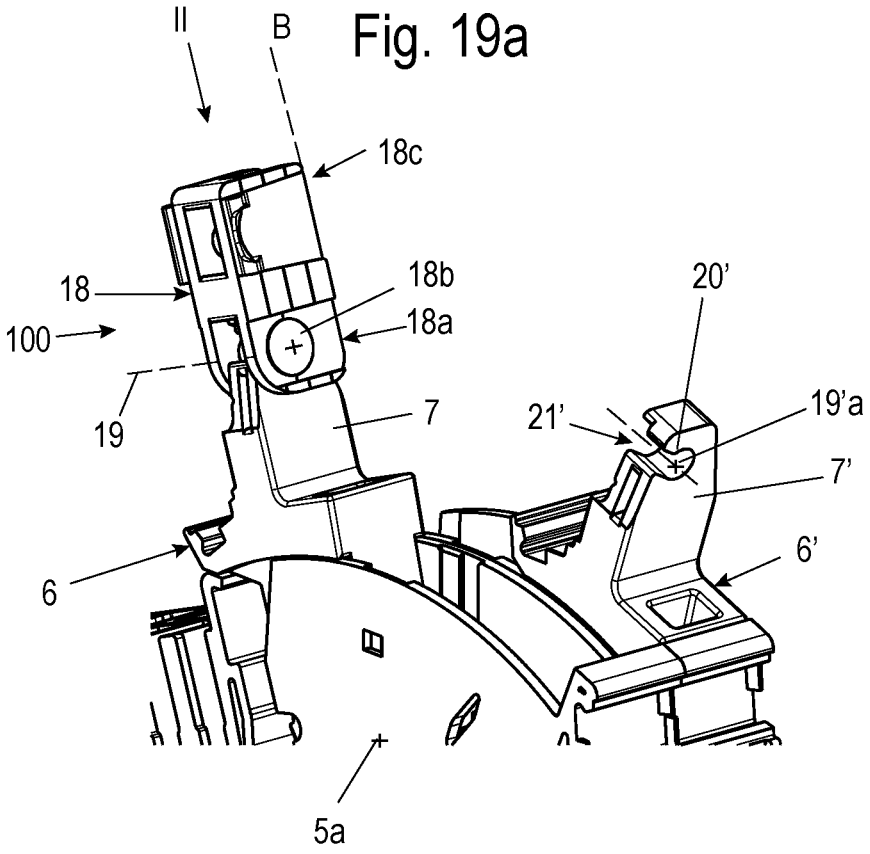

FIG. 19 shows the switch position I and the switch position II is shown in FIG. 19*a*. The coupling element 18 is in the coupling position B in each case, in which the two switching levers 6, 6' are neither coupled nor locked to one another.

FIG. 19 also shows the actuating section 7' of the switching lever 6', which is free in the second coupling position B of the coupling element 18. This actuating section 7' is formed exactly like the other actuating section 7 of the other switching lever 6. In other words, the switching levers 6, 6' and the actuating sections 7, 7' are identical. No special embodiments are required.

Figure 22:
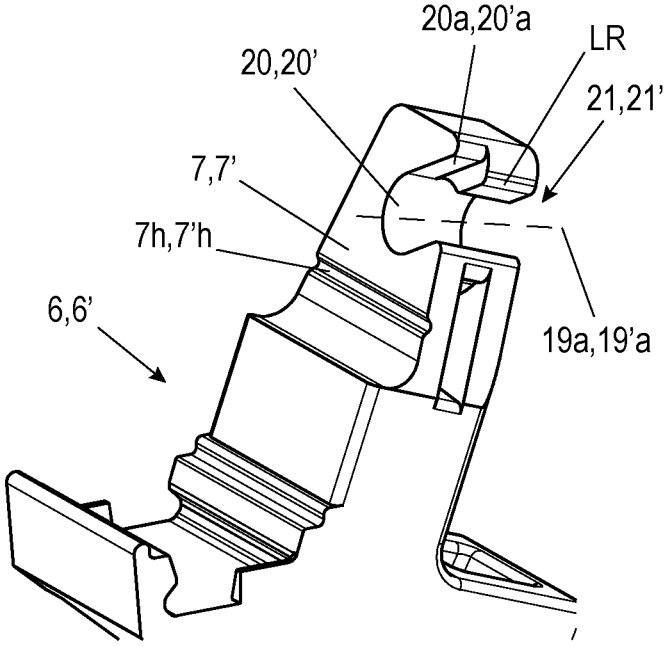
FIGS. 22-22*b* are perspective views, respectively, of an actuating section of a switching lever of the second exemplary embodiment according to FIG. 17.
Figure 22A:
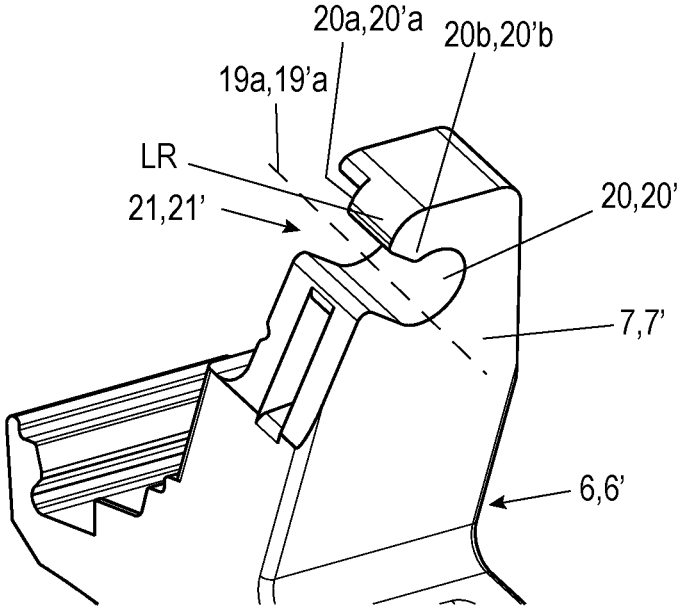
Figures 22B, 23, 24:
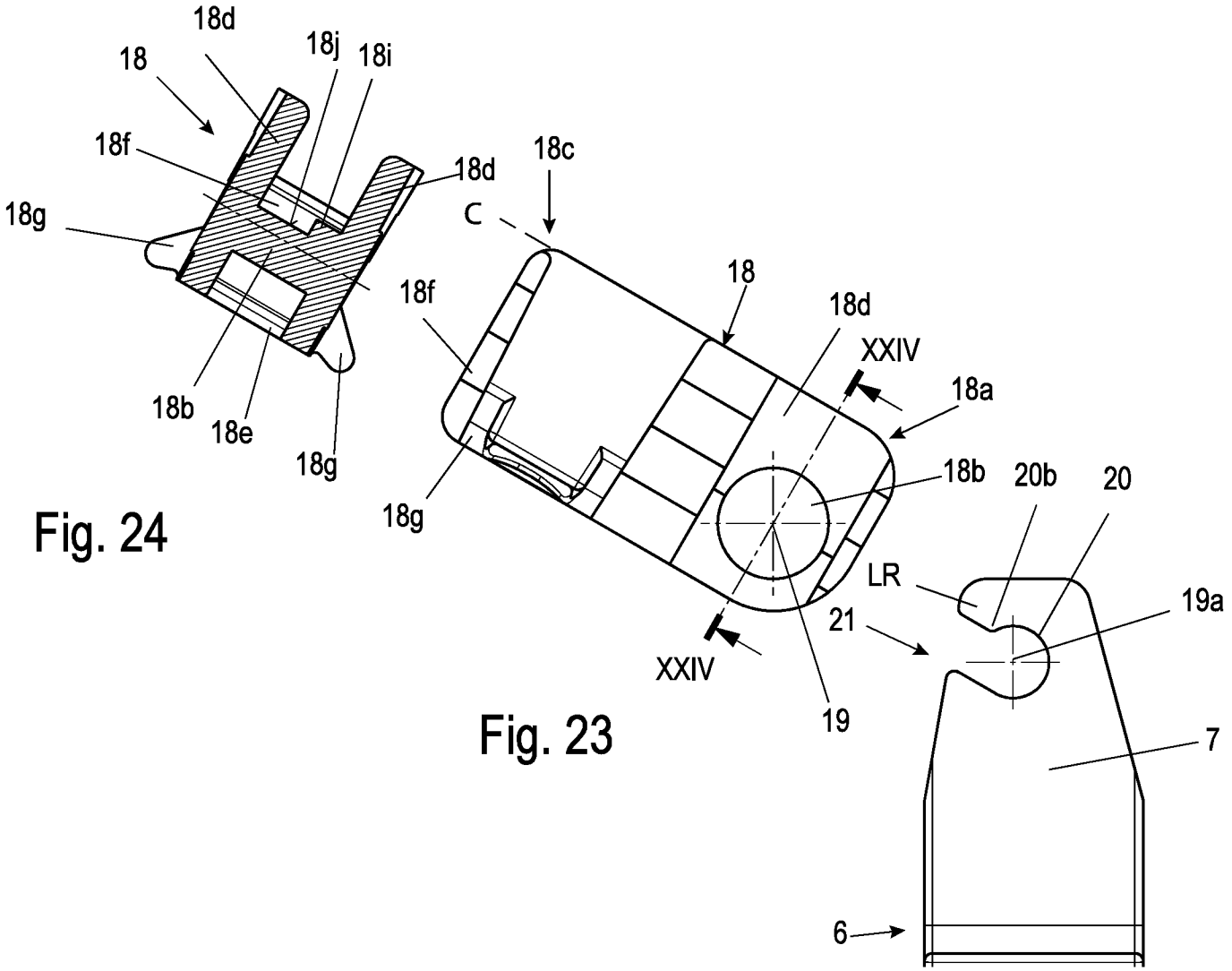

The actuating section 7, 7' of the switching lever 6, 6' of the second exemplary embodiment according to FIG. 17 is illustrated in schematic perspective views in FIGS. 22-22*a*. FIG. 22*b* shows a side view of the actuating section 7.

FIGS. 23-27 show the coupling element 18 and also at least partial illustrations of the actuating section 7, 7' of the second exemplary embodiment according to FIG. 17.

The actuating section 7, 7' is provided in its upper end region with a receptacle 20, 20'. The receptacle 20, 20' is circular-cylindrical, includes an axis 19*a*, 19'*a*, and extends perpendicularly to the pivot axis 5*a* of the switching levers 6, 6'. The axis 19*a*, 19'*a* forms a tangent to an imaginary circle, through the center point of which the pivot axis 5*a* extends.

The inner wall of the receptacle 20, 20' is interrupted by an opening 21, 21' extending in parallel to the direction of the axis 19*a*, 19'*a*. The opening 21, 21' has two regions having different opening widths. The first region (arranged on the left in FIG. 22) corresponds to approximately one fourth of the length of the opening 21, 21' and has a recess 20*a*, 20'*a* having an opening width which corresponds to the diameter of the receptacle 20, 20'. The second region (adjoining the first region on the right in FIG. 22) extends over a length of approximately three fourths of the total length of the receptacle 20, 20' and includes a protruding longitudinal edge LR. The opening width of this second region having the longitudinal edge LR is smaller than the diameter of the receptacle 20, 20'. The longitudinal edge LR of the opening 21, 21' includes an undercut 20*b*, 20'*b*.

Figure 20:
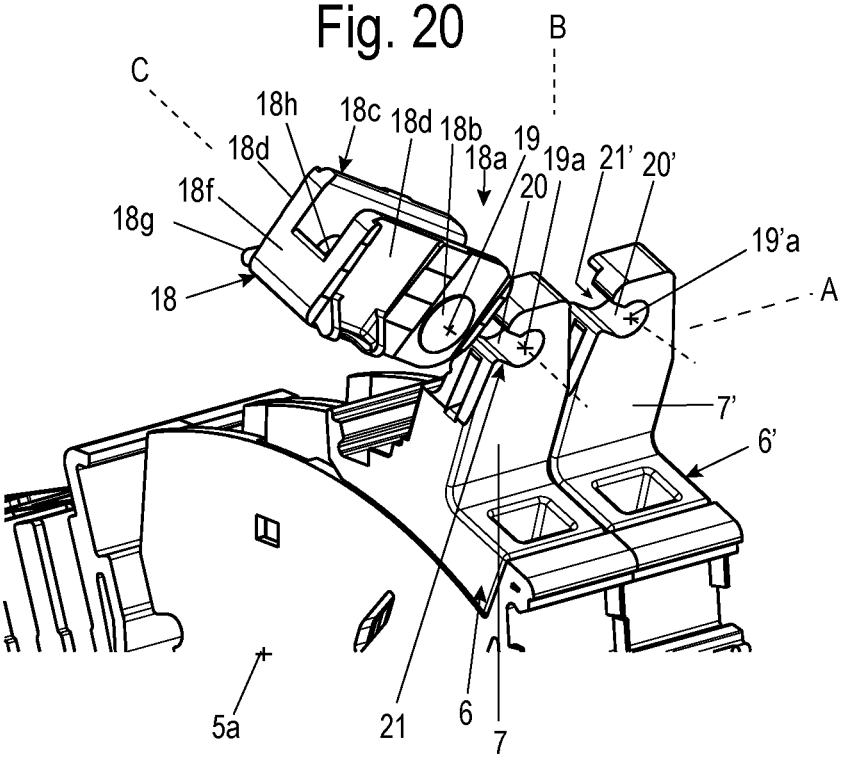
Figure 21:
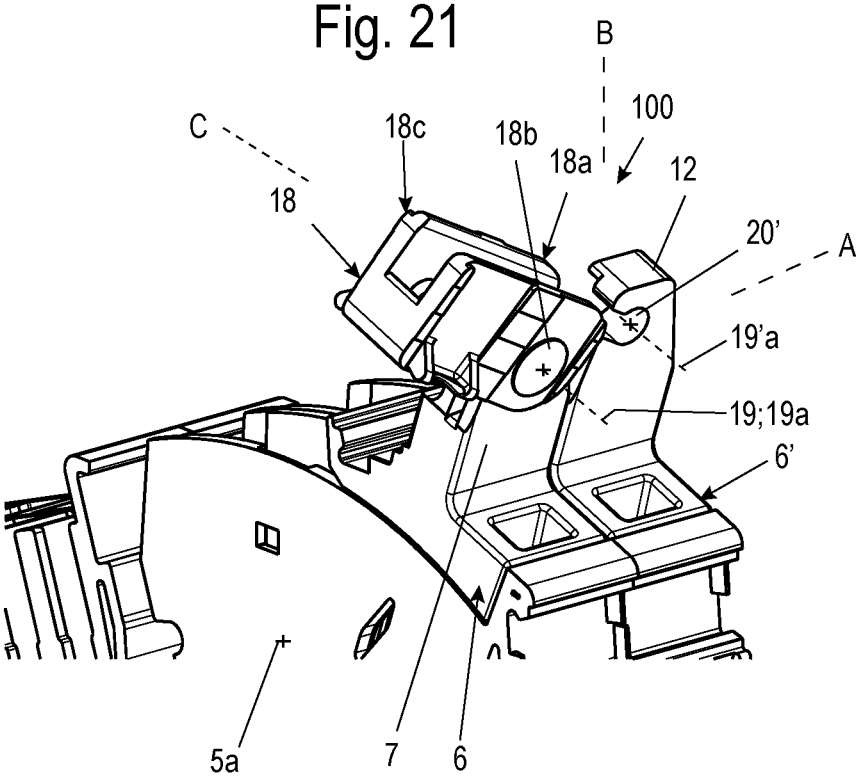

The coupling element 18 is inserted through the opening 21 during assembly into the receptacle 20 of the actuating section 7 of the switching lever 6 using the shaft section 18*b* of the pivot section 18*a*. This is only possible in a specific installation position C, which is shown in FIGS. 20-21. The coupling element 18 is at an angle of approximately 30° with respect to the pivot axis 5*a* in this case. The installation position is thus located by approximately 150° in relation to the first coupling position A with respect to the axis 19. If the coupling element 18 is in the installation position C, the key surface 18*j* faces upward. In this position, inserting the shaft section 18*b* into the receptacle 20 of the actuating section 7 is facilitated due to the flattened key surface 18*j* of the shaft section 18*b*, since the flattened key surface 18*j* reduces the outer dimension of the shaft section 18*b* in such a way that the shaft section 18*b* can be easily inserted into the receptacle 20, 20' due to the smaller opening width. The diameter of the disk-shaped solid shaft section 18*i* fits through the first region of the opening 21, 21' into the recess 20*a*, 20'*a*, which is provided for this purpose.

If the coupling element 18 is inserted in this manner in the installation position C into the receptacle 20, 20', as shown in FIG. 21, the coupling element 18 is pivoted into the second coupling position B. In this second coupling position B, in the first coupling position A, and in all other positions except for the installation position C, the coupling element 18 is held captively by the undercut 20*b* via the shaft section 18*b* in the receptacle 20.

In the installed state of the coupling element 18, the axis 19 of the shaft section 18*a* of the coupling element 18 and the axis 19*a* of the receptacle 20 extend coaxially to one another.

The coupling element 18 has two detent positions. The first detent position is formed in the first coupling position A in parallel to the pivot axis 5*a* of the switching levers 6, 6' by a detent device or by a detent mechanism. This detent device includes at least one projection 18*h* in the form of a spherical section. In the example shown, a projection 18*h* in the form of a spherical section on the inner sides of each of the side walls 18*d* in the region of the coupling section 18*c* of the coupling element 18 is engaged with the ends of the receptacle 20' of the actuating section 7' of the adjacent switching lever 6'. It is also possible that one or several projections 18*h* in the form of a spherical section are provided.

The second detent position of the coupling element 18 is the second coupling position B perpendicular to the pivot axis 5*a* of the switching lever 6, wherein a detent device or a detent mechanism is provided having a protruding section and an indented section corresponding thereto. In the example partially shown, this detent device includes an indentation 7*h*, 7'*h* in the form of an elongated groove as a section indented in one side of the actuating section 7, 7' and a web 18*k* as a protruding section on an inner side of the side wall 18*d* of the coupling element 18 in the region of the pivot section 18*a*. The web 18*k* is formed in the end region of the side wall 18*d* of the coupling element 18 in the pivot section 18*a* perpendicularly to the longitudinal edges of the side walls 18*d*. This is clearly apparent in FIGS. 18 and 18*a*, where the web 18*k* is perpendicular to the pivot axis 5*a* and also perpendicular to the indentation 7*h* in the first coupling position A. In the second coupling position B, the web 18*k* is engaged with the indentation 7*h*. This is apparent in FIG. 25. The web 18*k* extends in parallel to the pivot axis 5*a* and in parallel to the indentation 7*h*.

In a further example, this detent device for the second coupling position B can include a projection, which is not shown, but is easily conceivable (or two or multiple, similar to the projections 18*h*) on the inner sides of the side walls 18*d* in the pivot section 18*a* of the coupling element 18, which is/are engaged in the second coupling position B with an end of the opening 21, 21' and/or an end of the receptacle 20, 20' between longitudinal edge LR and a lower longitudinal edge.

Figure 28:
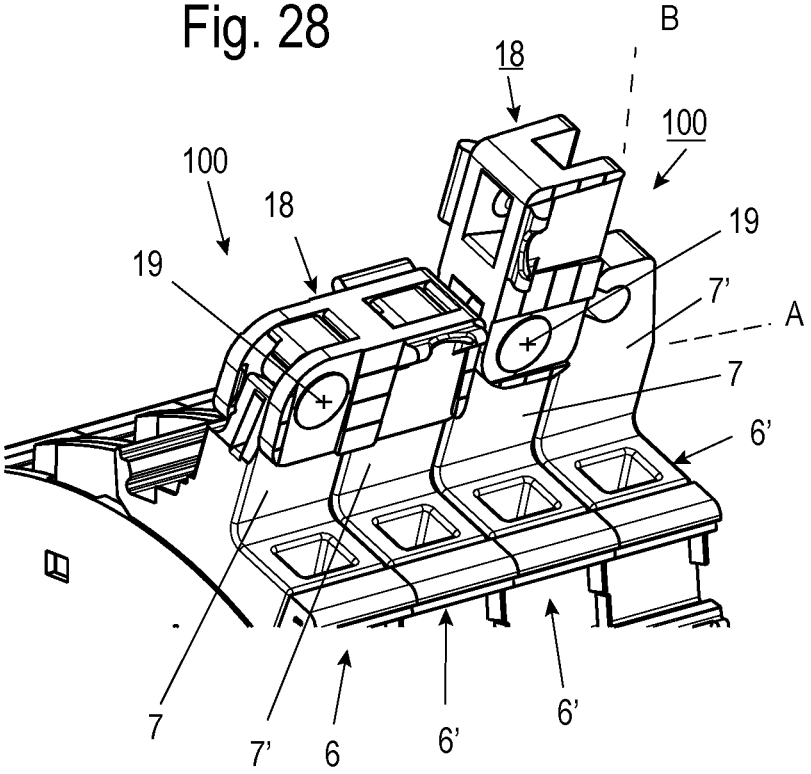
FIGS. 28 and 29 are partial perspective views, respectively, of disconnect terminals according to the second exemplary embodiment according to FIG. 17.

If a further switching lever (for example, in front of the front switching lever 6 in FIG. 21) is located adjacent, the coupling element 18 cannot be pivoted into the installation position C and cannot be removed. This is illustrated in FIG. 28.

In this embodiment, the movement direction of the coupling element 18 extends rotationally around the axis 19. However, the movement can also be rotationally designed in addition by another type of trajectory, but in a plane different than the actuating plane of the switching lever 6. The movement is also conceivable along another trajectory.

FIG. 23 is a side view of the coupling element 18 in the installation position C with respect to the actuating section 7 of the switching lever 6 shown adjacent. The axis 19 extends outside an imaginary longitudinal axis of the coupling element 18 here.

A cross section through the coupling element 18 in the region of the pivot section 18*a* through the shaft section 18*b* is shown in FIG. 24. The shaft section 18*b*, the disk-shaped solid shaft section 18*i*, and the side walls 18*d* are formed in one piece, for example from a suitable plastic material. The key surface 18*j* is arranged between the left side wall 18*d* and the disk-shaped solid shaft section 18*i*. A reduction of the external dimension of the shaft section 18*b* in relation to the solid shaft section 18*i* is clearly apparent.

FIG. 25 shows a side view of actuating section 7 of the switching lever 6 and the coupling element 18 located in the second coupling position B. The projections 18*h* in the form of spherical sections of the detent device protrude into the interior of the coupling section 18*c* from the inner sides of the sidewalls 18*d* in the region of the coupling section 18*b* of the coupling element 18.

In FIG. 26, the coupling element 18 of the detent device is in the first coupling position A. A sectional illustration along line XXVII to the coupling section 18*c* is shown in FIG. 27, wherein the projections 18*h* are engaged with the open ends of the receptacle 20' of the actuating section 7' of the adjacent switching lever 6' and form a detent position.

An additional detent device for the first coupling position A is indicated in FIG. 27, which (like the detent device for the above-described second coupling position B), includes a protruding section as a web 18'*k* and an indented section as an indentation 7'*h* of the actuating section 7' of the switching lever 6'. The web 18'*k* is arranged in the coupling section 18*c* of the coupling element 18 on its side wall 18*d* in parallel to its longitudinal edge. In the first coupling position A, the web 18'*k* extends in parallel to the pivot axis 5*a* and in parallel to the indentation 7'*h* and is engaged with the indentation 7'*h*.

The webs 18*k*, 18'*k* and the associated indentations 7*h*, 7'*h* can of course also be arranged at other angles in relation to the pivot axis 5*a* for the two coupling positions A, B. They can also have other shapes, for example spherical section, polygonal, oval shape, cross shape, etc. Of course, these detent devices for the coupling positions A, B are also expandable for further coupling positions of the coupling element 18.

Using this principle of the coupling element 18 of the second exemplary embodiment, independent switching of adjacent switching levers 6, 6' is possible from any position.

Figure 29:
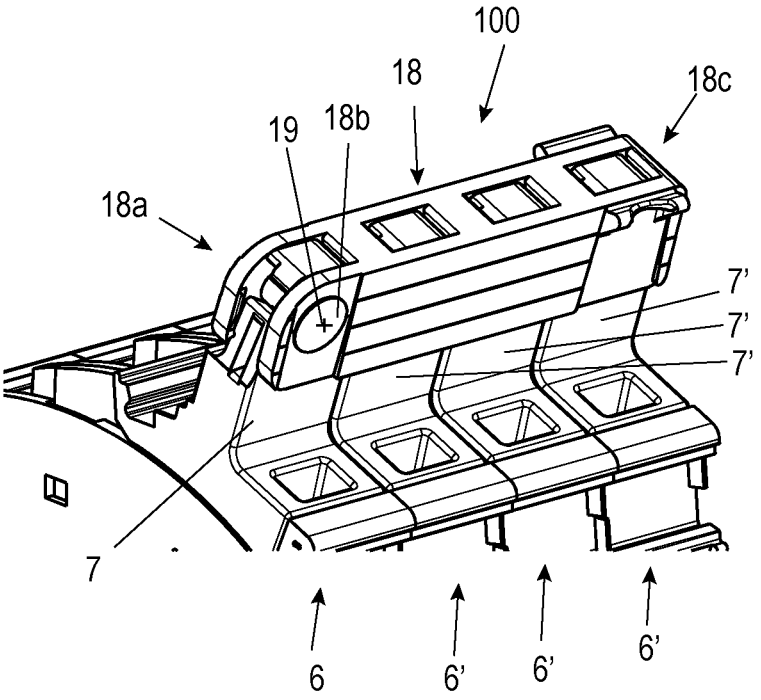

FIGS. 28 and 29 show coupling devices 100 of disconnect terminals 1, 1' according to the second exemplary embodiment according to FIG. 17.

FIG. 28 shows two pairs of switching levers 6, 6' in which the two front switching levers 6, 6' are shown having the coupling element 18 of the coupling device 100 in the coupling position A. The coupling element 18 of the other coupling device 100 is in the second coupling position B.

The coupling element 18 can also be designed for more than two switching levers 6, 6'. FIG. 29 shows an example for four switching levers 6, 6'. The coupling element 18 is correspondingly embodied longer. The regions of the coupling element 18 which couple the actuating sections 7' of the middle switching lever 6' can also be provided with corresponding projections 18*h*.

FIGS. 30-33*a* show a coupling device 100 of a third exemplary embodiment of disconnect terminals 1, 1'.

This coupling device 100 includes a rotatable or pivotable coupling element 22, 22', which is arranged in a receptacle 23, 23' in the actuating section 7, 7' of a switching lever 6, 6'.

The receptacle 23, 23' is open toward the side section 7*d*, 7'*d* (see FIG. 1) of the actuating section 7, 7' via a slot 25, 25'. Toward the other side section 7*c*, 7'*c*, the receptacle 23, 23' is open through an intermediate wall 27, 27' of a further receptacle 24, 24', which in turn is open toward the other side section 7*c*, 7'*c* of the actuating section 7, 7', also through a slot 25*a*, 25'*a*.

Figure 33:
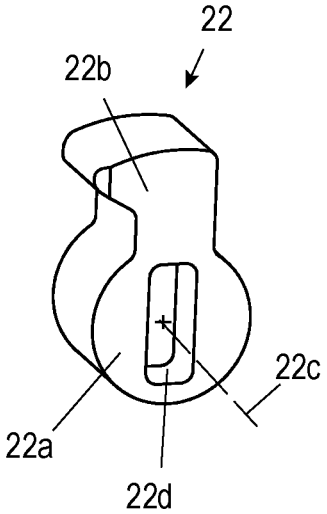
Figure 33A:
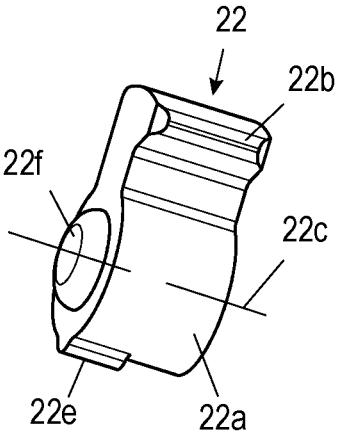

The coupling element 22, 22' is shown in perspective from various views and installed in FIGS. 33 and 33*a* It includes a cylindrical body 22*a*, 22'*a* having a pivot axis 22*c*, 22'*c*. An arm having a hook section 22*b*, 22'*b* is radially attached to the body 22*a*, 22'*a*. The body 22*a*, 22'*a* includes an actuating section 22*d*, 22'*d* in the form of a slot, for a suitable tool, for example a screwdriver, on one end face. The other end face of the body 22*a*, 22'*a* is provided with a centrally formed bearing projection 22*f*, 22'*f*, which is a spherical section. A lug or cam 22*e*, 22'*e* is attached diametrically to the formed hook section 22*b*, 22'*b* on the outer side of the body 22*a*, 22'*a*. This lug 22*a*, 22'*a* extends from the end face of the body 22*a*, 22'*a* with the bearing section 22*f*, 22'*f* in parallel to the pivot axis 22*c*, 22'*c* to approximately half of the length of the body 22*a*, 22'*a*.

The receptacle 23, 23' corresponds to the shape of the coupling element 22, 22' and is closed in its lower section with a curved receptacle wall 27*a*, 27'*a* having an undercut 23*a*, 23'*a* in the region of the slot 25, 25', the radius of which corresponds to the radius of the body 22*a*, 22'*a* of the coupling element 22, 22'.

The receptacle 24, 24' corresponds to the hook section 22*b*, 22'*b* of the coupling element 22, 22' and has an undercut 24*a*, 24'*a* in its lower region, which is provided to engage with the hook section 22*b*, 22'*b* of the coupling element 22, 22' in the slot 25*a*, 25'*a*.

The receptacles 23, 23' and 24, 24' are closed using the end face sections 7*a*, 7'*a* and 7*b*, 7'*b* of the actuating sections 7, 7', wherein openings 26, 26' for access to the slot 22*d*, 22'*d* of the coupling element 22, 22' for the pivoting thereof are indented in the region of the body 22*a*, 22'*a* of the coupling element 22, 22' in the end face section 7*b*, 7*b*', and wherein bearing sections 29, 29 are introduced into the opposing end section 7*a*, 7'*a* for mounting the bearing projections 22*f*, 22'*f* of the coupling elements 22, 22'. In this way, the coupling element 22, 22' is pivotably guided by the bearing sections 29, 29' and the lower receptacle wall 27*a*, 27'*a* and the intermediate wall 27, 27' around the pivot axis 22*c*, 22'*c* in the receptacle 23, 23'.

The pivot axis 22*c*, 22'*c* is perpendicular to the pivot axis 5*a* of the switching lever 6, 6' and tangential to an imaginary circle having a center point, through which the pivot axis 5*a* of the switching lever 6, 6' extends.

The coupling element 22, 22' is clipped from the side section 7*d*, 7'*d* through the slot 25, 25' into the receptacle 23, 23', wherein the undercut 23*a*, 23'*a* and the bearing projection 22*f*, 22'*f* in the form of a spherical section hold the coupling element 22, 22' captively in the receptacle 23, 23'.

Figure 30:
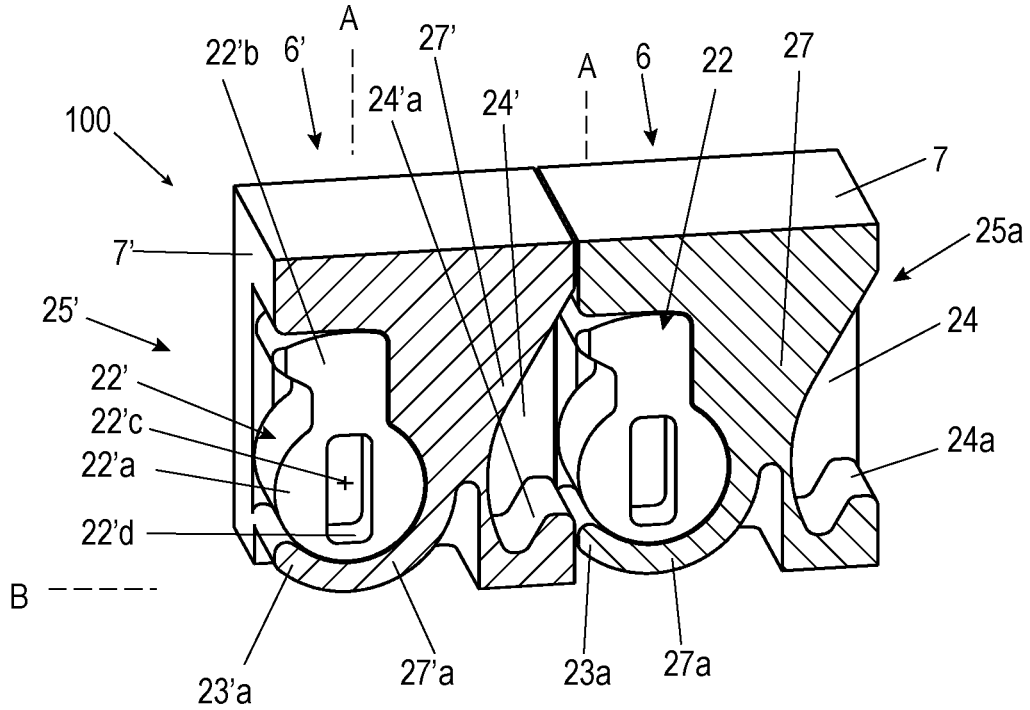
FIGS. 30-33*a* are various views of a coupling device of a third exemplary embodiment of disconnect terminals.

FIG. 30 shows two coupling elements 22, 22' in adjacent actuating sections 7, 7' of adjacent switching levers 6, 6' in the first coupling position A. The hook sections 22*b*, 22'*b* are inside the receptacles 23, 23'.

Figure 30A:
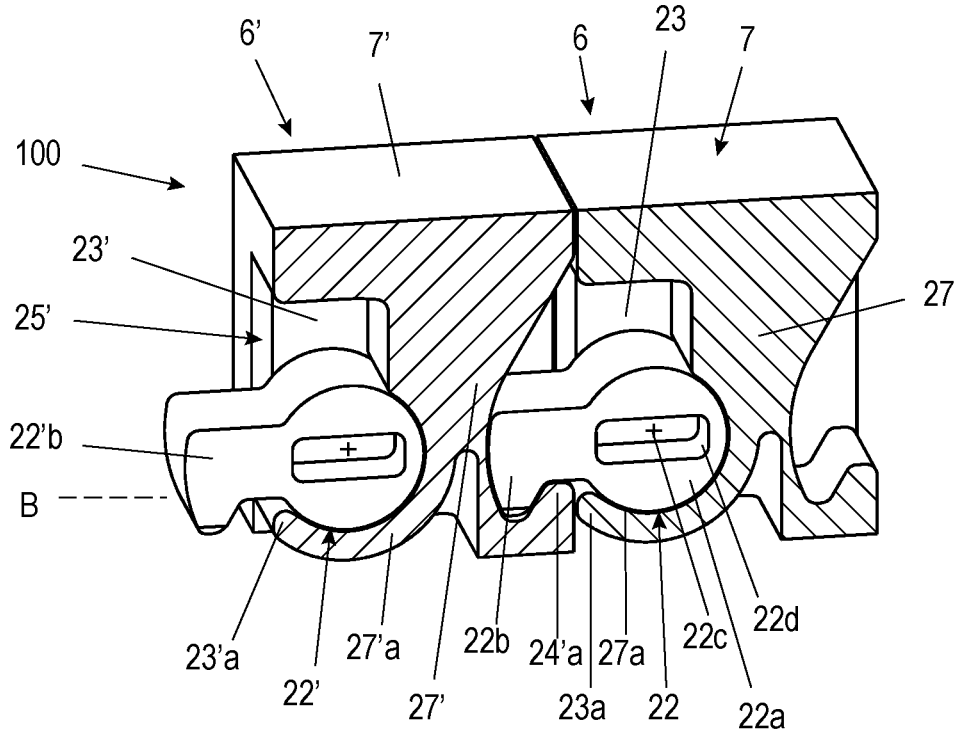
Figure 30B:
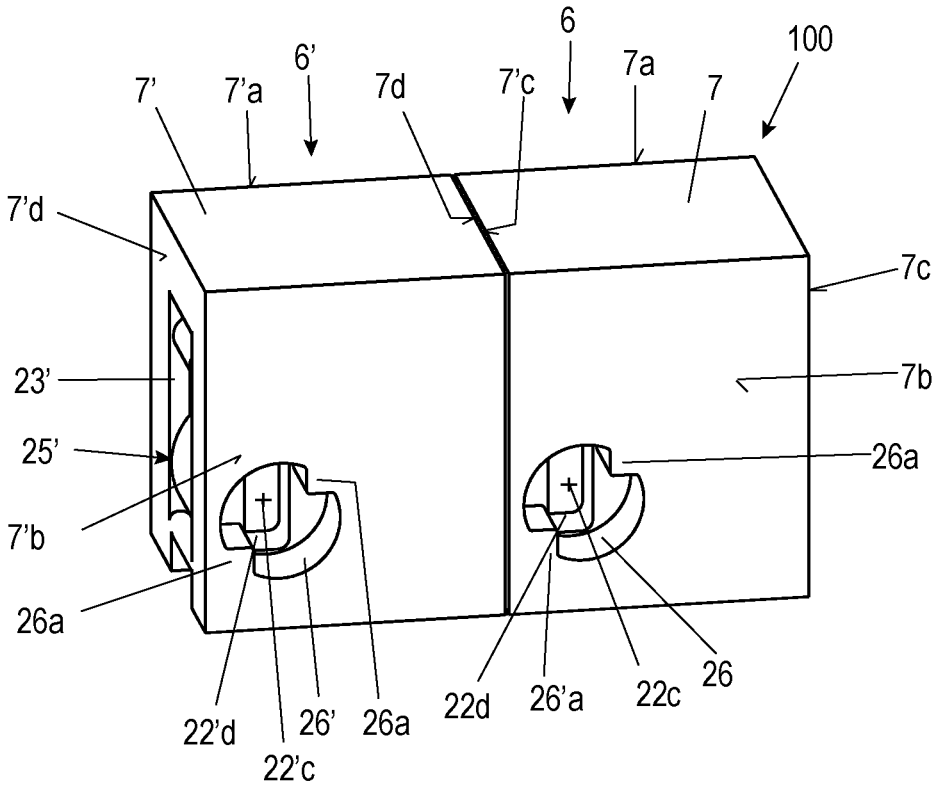

FIG. 30*b* shows the receptacles 23, 23'; 24, 24' closed by the side sections 7*b*, 7'*b* with the openings 26, 26' through which, using a tool, preferably a screwdriver, engaged with the actuating sections 22*d*, 22'*d*, the coupling elements 22, 22' can each be pivoted around the pivot axes 22*c*, 22'*c* out of the first coupling position A into the second coupling position B and back.

The openings 26, 26' are provided with additional stops 26*a*, 26'*a* for the tool, in order to restrict pivoting of the coupling element 22, 22' to the coupling positions A and B.

Figure 30C:
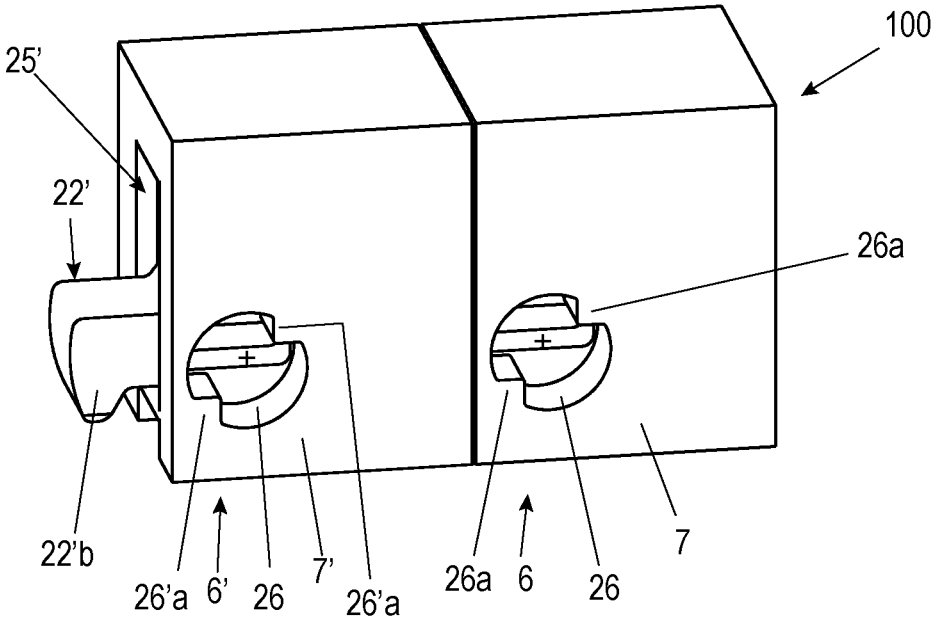

In FIGS. 30*a* and 30*c*, the second coupling positions B are shown.

The coupling elements 22, 22' are pivoted such that the hook sections 22*b*, 22'*b* extend through the slots 25, 25' and are engaged with the receptacle 24 of the adjacent actuating section 7, 7', whereby coupling of the adjacent switching levers 6, 6' is enabled.

It is also conceivable for two opposing hook sections 22*b*, for example in the form of an anchor, to be provided, wherein the coupling element 22, 22' is pivotable in two different pivot directions, wherein it occupies a middle position in the second coupling position B.

Figure 31:
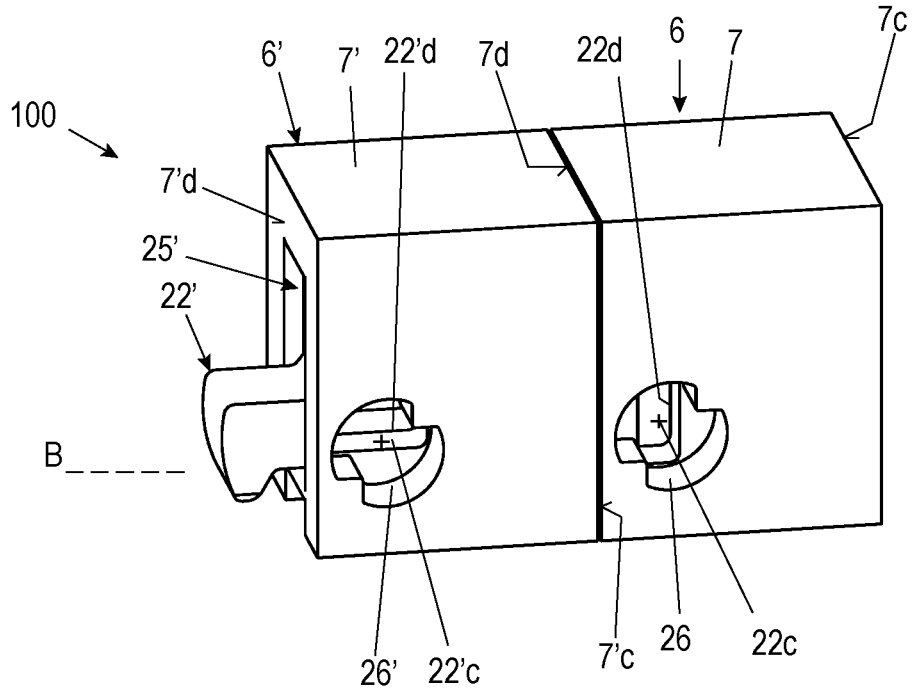

In FIG. 31, only one coupling element 22' is pivoted into the second coupling position B, the other coupling element 22 has remained in the first coupling position A. The coupling elements 22, 22' are thus switchable and/or adjustable and/or pivotable independently of one another.

Independent movements of the switching levers 6, 6' are thus possible as soon as the coupling element 22, 22' on the respective adjacent switching lever 6, 6' is switched to the first coupling position A, and thus does not lock with the adjacent switching lever(s) 6, 6'.

Figure 31A:
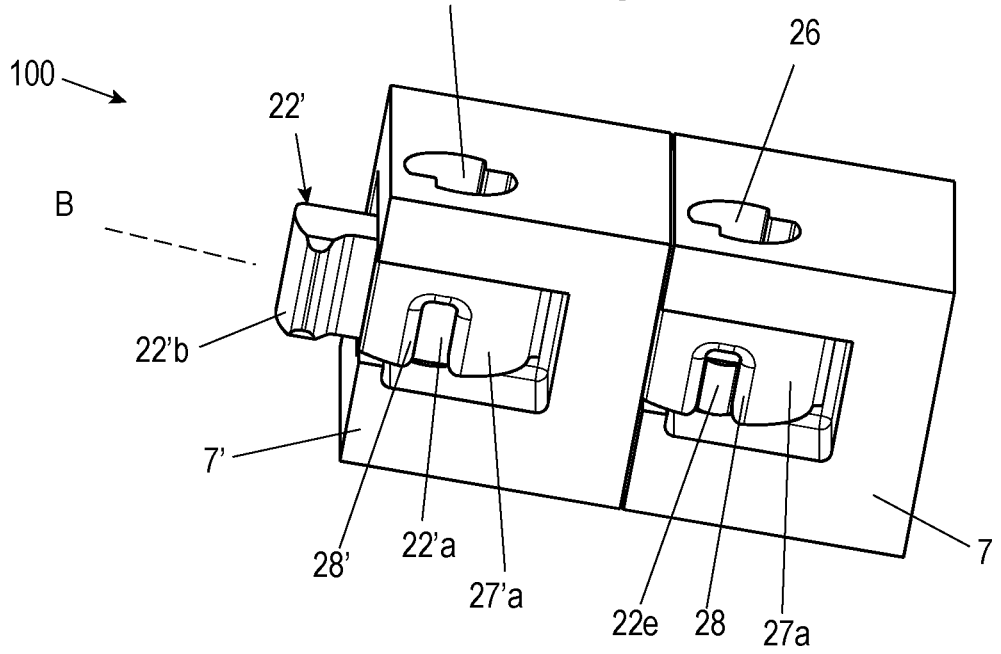

The lower side of the receptacle wall 27*a*, 27'*a* is shown having a recess 28, 28' in each case in FIG. 31*a*.

Figure 31B:
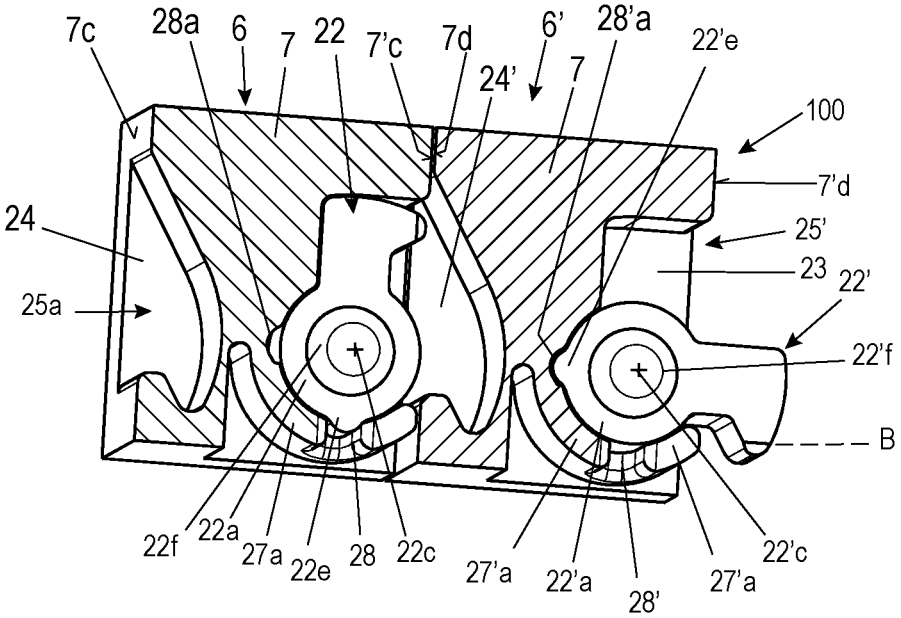
Figure 31C:
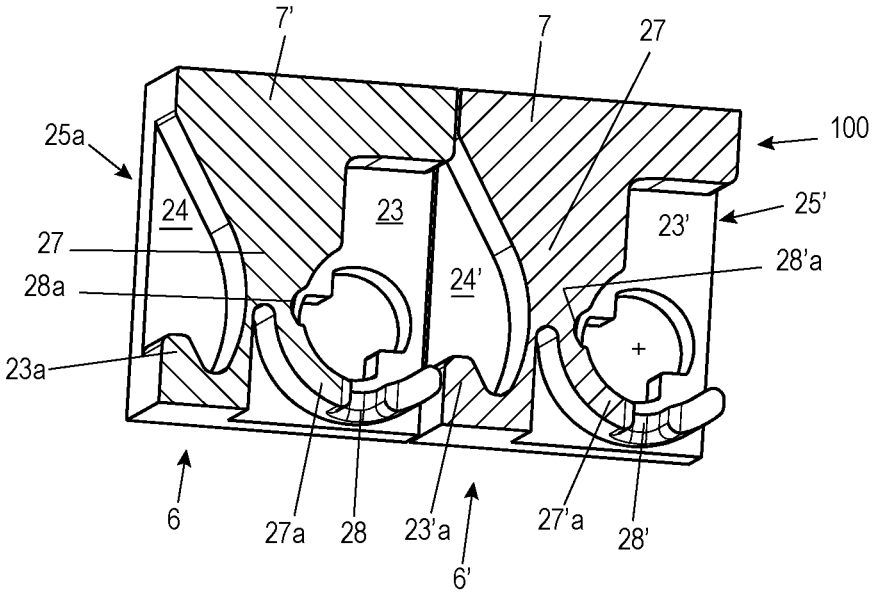

FIG. 31*b* shows the coupling elements 22, 22' from FIGS. 31 and 31*a* without side sections. In FIG. 31*c* only the open receptacles 23, 23'; 24, 24' are shown without coupling elements 22, 22'.

The intermediate wall 27, 27' also includes a recess 28*a*, 28'*a*.

The recesses 28, 28'; 28*a*, 28'*a* correspond in the shape thereof to the lug 22*e*, 22'*e* of the coupling element 22, 22'.

As is clearly apparent from FIGS. 31*a* and 31*b*, the lug 22*e* of the coupling element 22 located in the first coupling position A is engaged with the recess 28 in the lower receptacle wall 27*a* and thus forms a locking device of the coupling element 22 in the first coupling position A.

The lug 22'*e* of the other coupling element 22', which is in the second coupling position B, is engaged with the other recess 28'*a* in the intermediate wall 27. A locking of the coupling element 22' in the second coupling position B is thus enabled.

Figure 32:
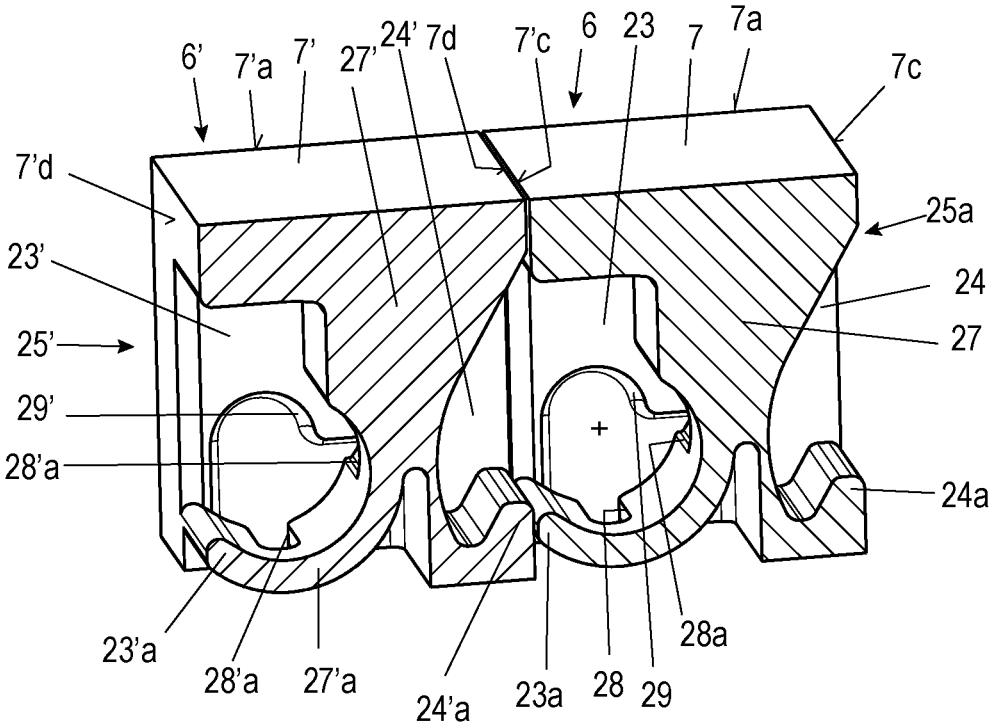

The recesses 28, 28' and 28*a*, 28'*a* are shown enlarged in FIG. 32 together with the bearing sections 29, 29'.

The regions of the actuating sections 7, 7' of the switching levers 6, 6' having the indented receptacles 23, 23'; 24, 24' are shown box-shaped. These box-shaped regions are embodied in one piece with the switching levers 6, 6'.

In another embodiment, these box-shaped regions or receptacle sections can also be formed as separate parts, which are attached in a suitable manner to the switching levers 6, 6'. Such an attachment can be formed, for example, as a clip connection, tongue-and-groove connection, screw connection, plug connection, or the like.

FIGS. 34-40*c* show schematic views of switch status displays 30.

The respective switch position I, II, i.e., the connection position and the separation position of the switching levers 6, 6', is visibly displayed by the switch status display 30.

This is carried out in such a way that, on the one hand, a first display portion 31 is arranged on the movable switching lever 6, 6' or the actuating section 7, 7', and, on the other hand, a second display portion 32 matching thereto is attached to the fixed housing. In the first switch position I ("closed") these two display portions 31 and 32 are unified in such a way that a "closed" symbolism is clearly visible. And in the second switch position II ("separated") this symbolism is separated, from which a separation is clearly apparent.

The following geometrical solutions are possible for this purpose:

geometric break (For example, separate/combined two semicircles—closed circle)

fork and connection point geometric elements designed in the form of arrows, which are not visible in the switch position I.

switch symbols: fork having connection point or switch symbol open/closed surfaces flush in switch position I elements can be colored to represent togetherness, to offer contrast or a traffic signal function.

Different examples of this are shown in FIGS. 34-40*c*.

Figure 34:
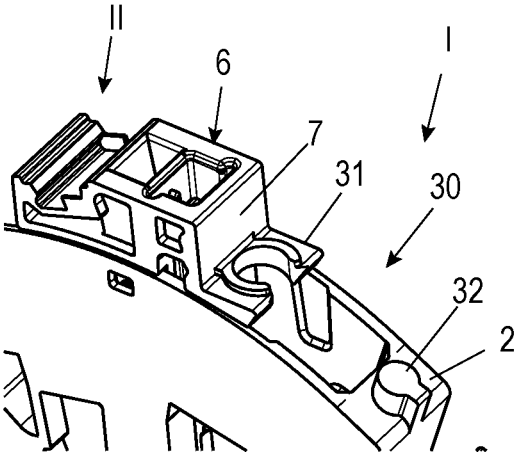
FIGS. 34-40*c* are various views of switch status displays.
Figure 34A:
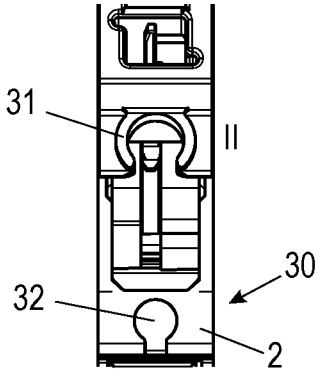
Figure 34B:
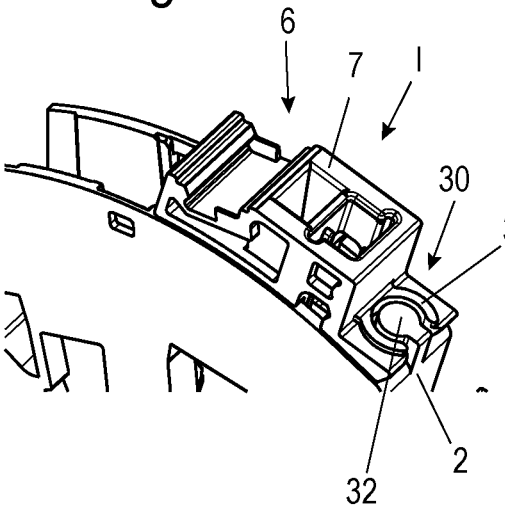
Figure 34C:
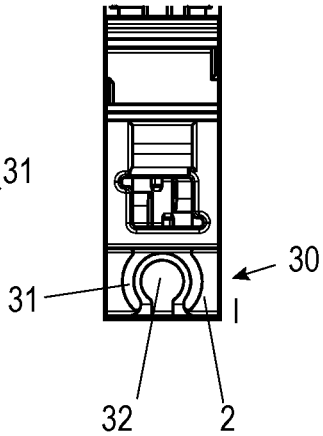

FIGS. 34 and 34*a* show the switch position II, wherein FIGS. 34*b* and 34*c* display the switch position I. In this case, the movable display portion 31 is a forked circular arc, which encloses the fixed display portion 32, which is formed as a protruding circular cylinder, in the switch position II.

Figure 35:
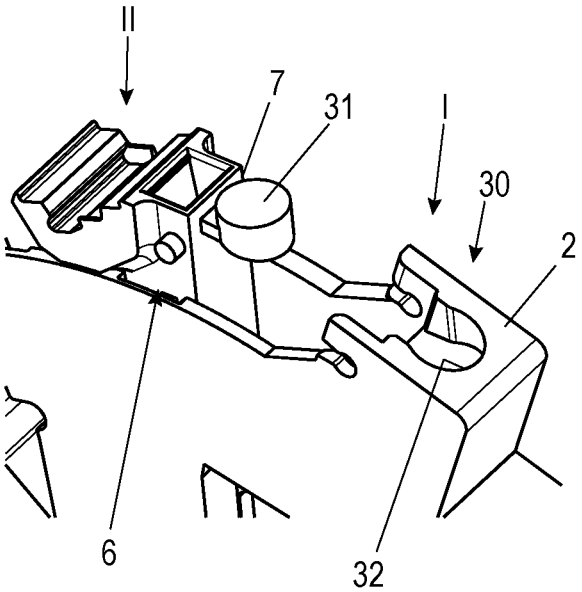
Figure 35A:
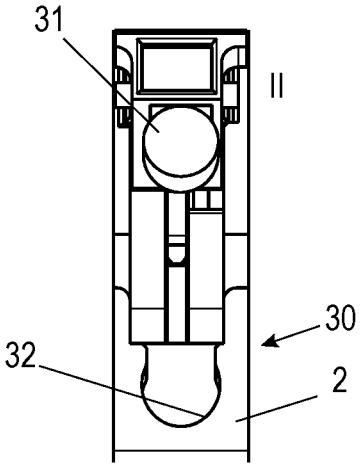
Figure 35B:
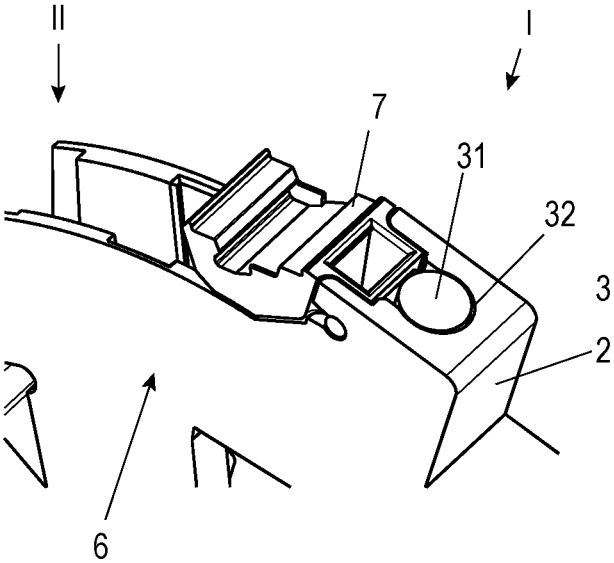
Figure 35C:
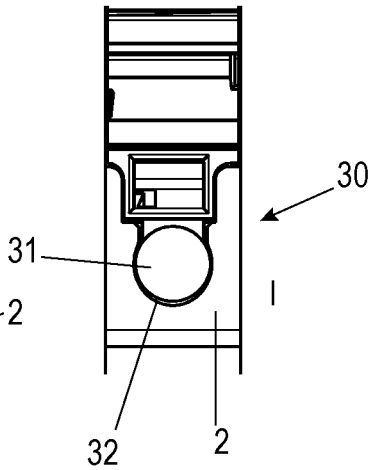

The geometric reversal is shown in FIGS. 35 and 35*a* in switch position II and in FIGS. 35*b* and 35*c* in switch position I. The circular cylinder is now the movable display portion 31, which is enclosed in switch position I by a receptacle corresponding thereto as the fixed display portion 32.

Figure 36:
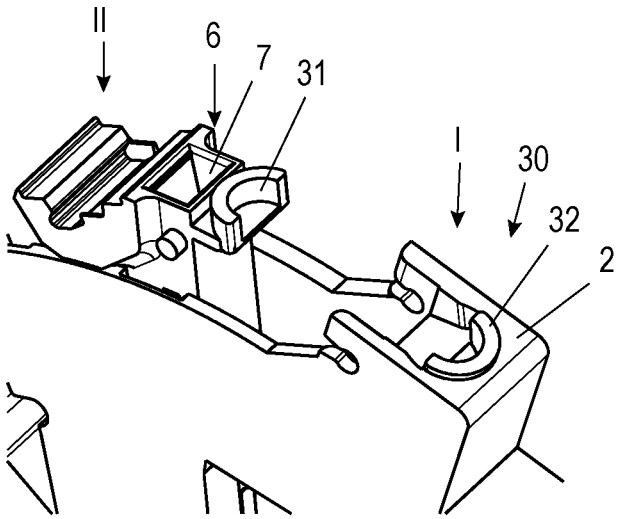
Figure 36A:
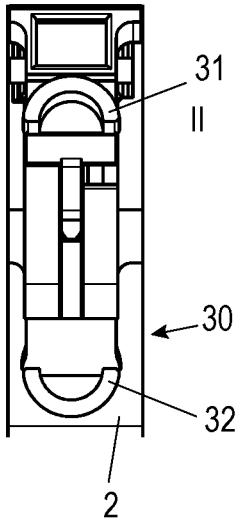
Figure 36B:
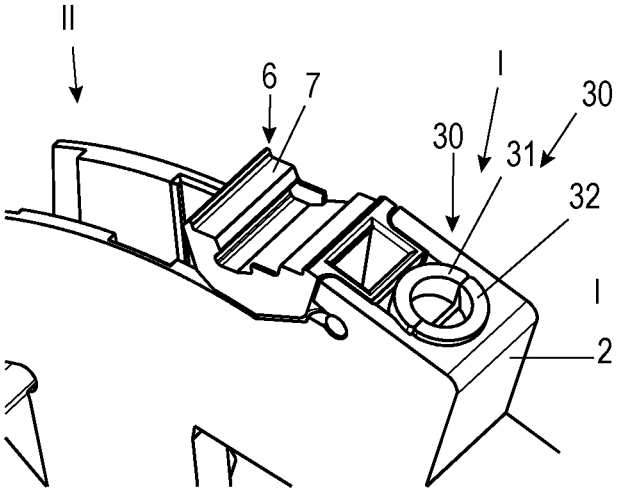
Figure 36C:
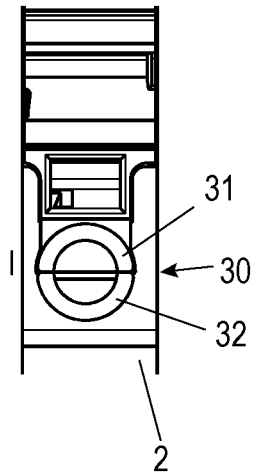

FIGS. 36-36*c* show the separated two semicircles, which are then brought together as a closed circle in switch position I.

Figure 37:
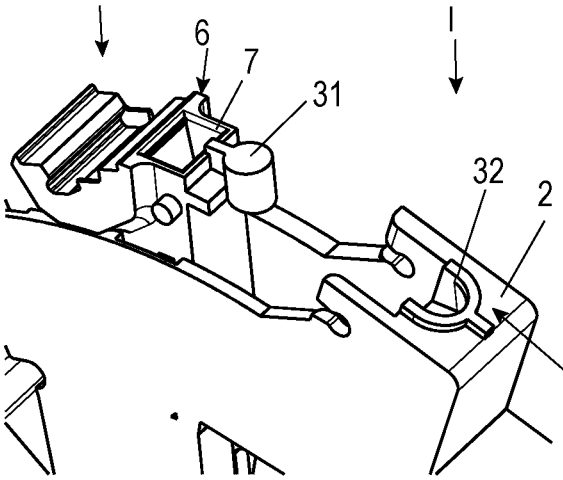
Figure 37A:
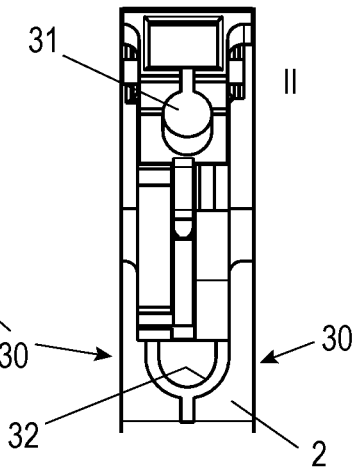
Figure 37B:
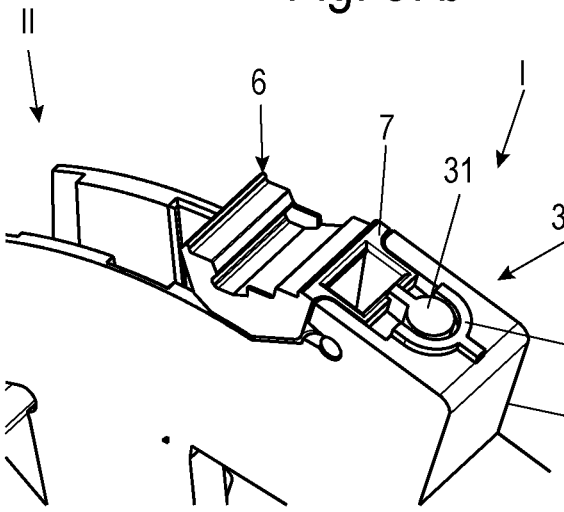
Figure 37C:
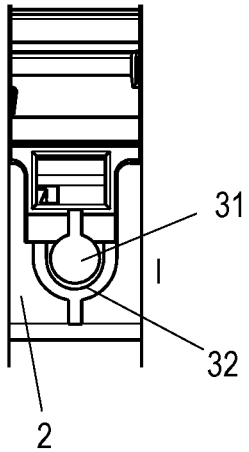
Figure 38:
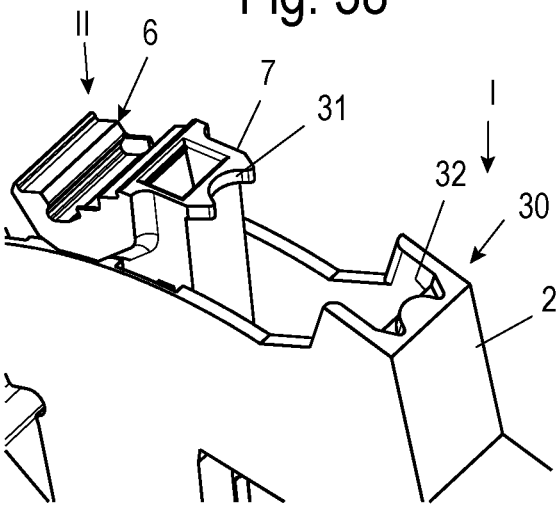
Figure 38A:
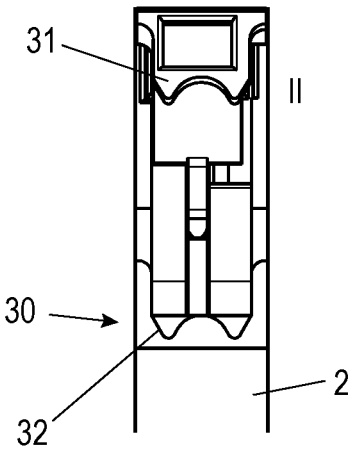
Figure 38B:
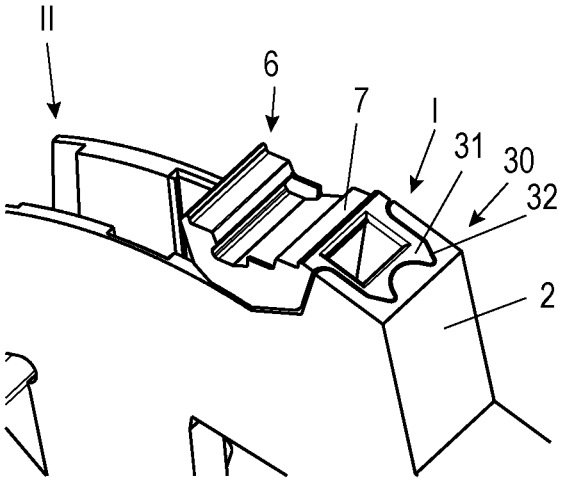
Figure 38C:
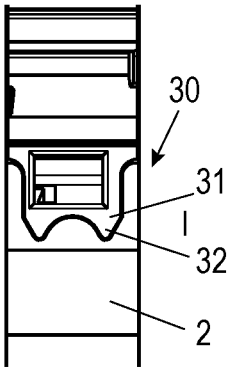
Figure 39:
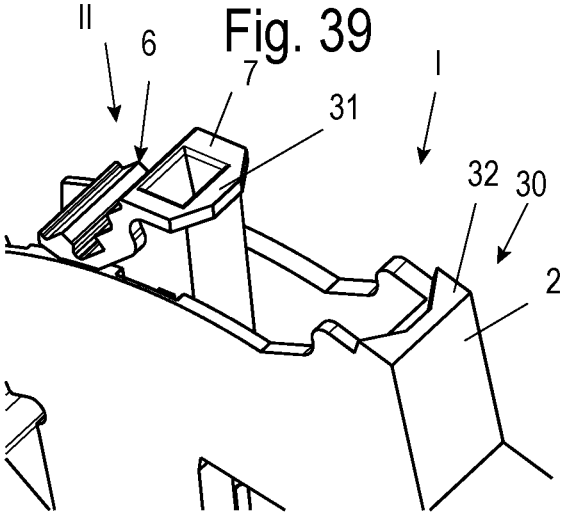
Figure 39A:
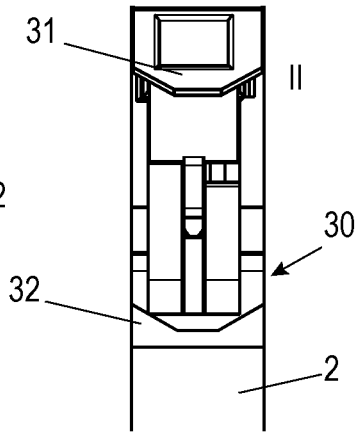
Figure 39B:
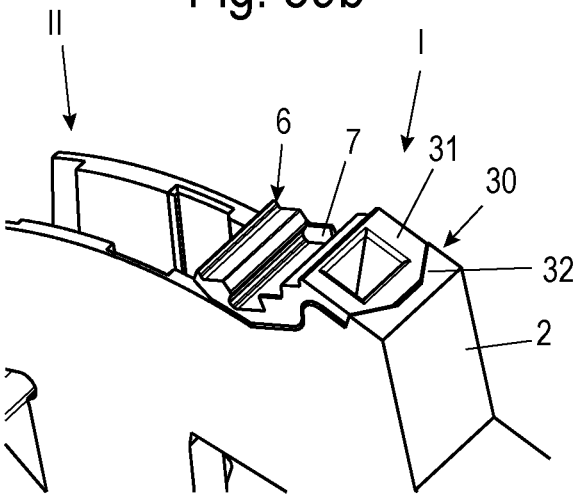
Figure 39C:
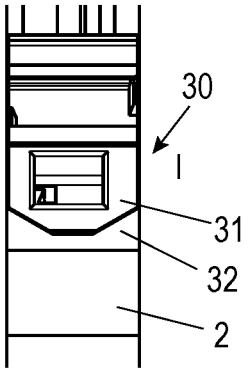

FIGS. 37-37*c* show an alternate of the embodiment according to FIGS. 35-35*c*, wherein the fixed display portion 32 includes an upwardly protruding symbol, which represents the switching state I as a plugged-together plug connection circuit symbol.

FIGS. 38-38*c* and FIGS. 39-39*c* each show a cut-through contour, which can be recognized as joined in the switch status I.

Figure 40:
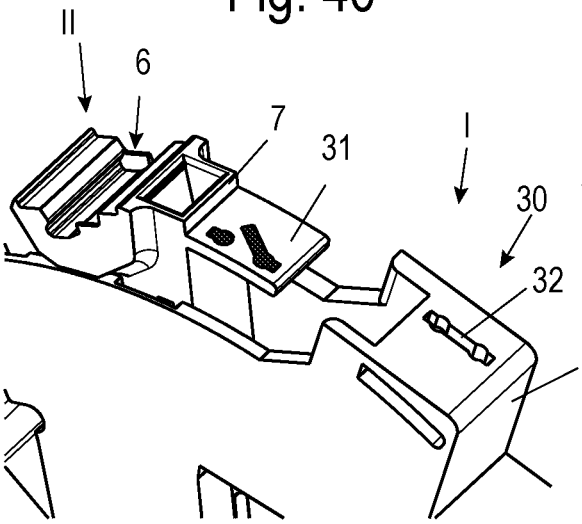
Figure 40A:
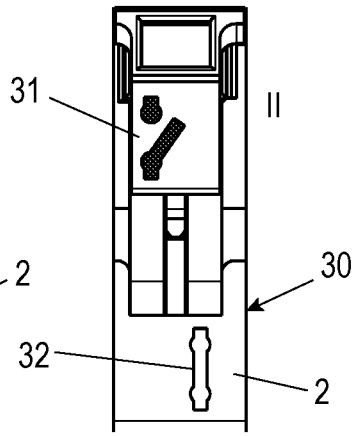
Figure 40B:
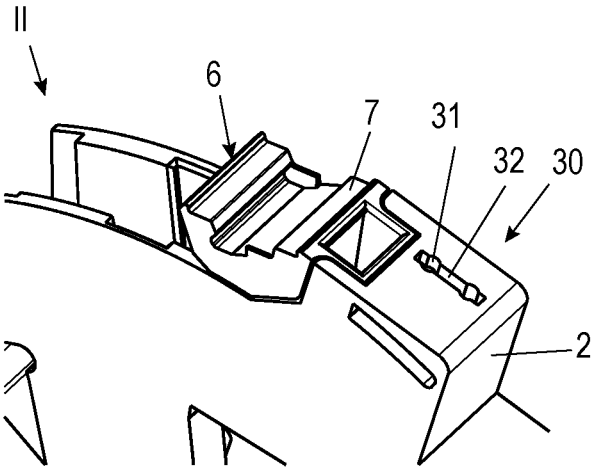
Figure 40C:
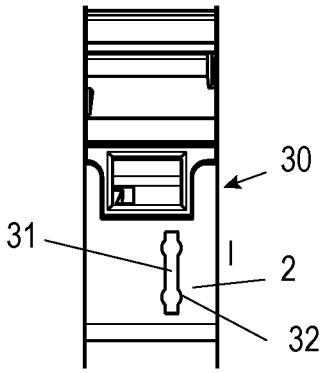

FIGS. 40 and 40*a* show a colored circuit symbol of an open switch as the movable display portion 31. The fixed display portion 32 is an opening in the form of the circuit symbol for a closed switch. In the switch position I, the circuit symbol of the open switch is no longer visible, wherein the opening in the form of the circuit symbol for the closed switch is represented by the colored background of the movable display portion 31 located underneath.

The switch status display can also be designed having a type of traffic signal function.

Figure 41A:
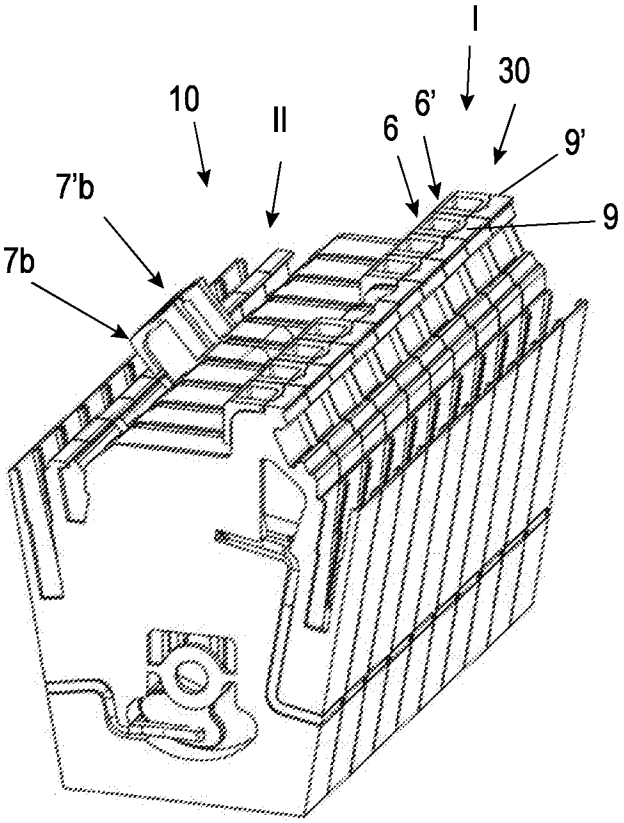
FIGS. 41 and 41*a* are perspective views, respectively, of arrangements of disconnect terminals according to the invention.
Figure 41:
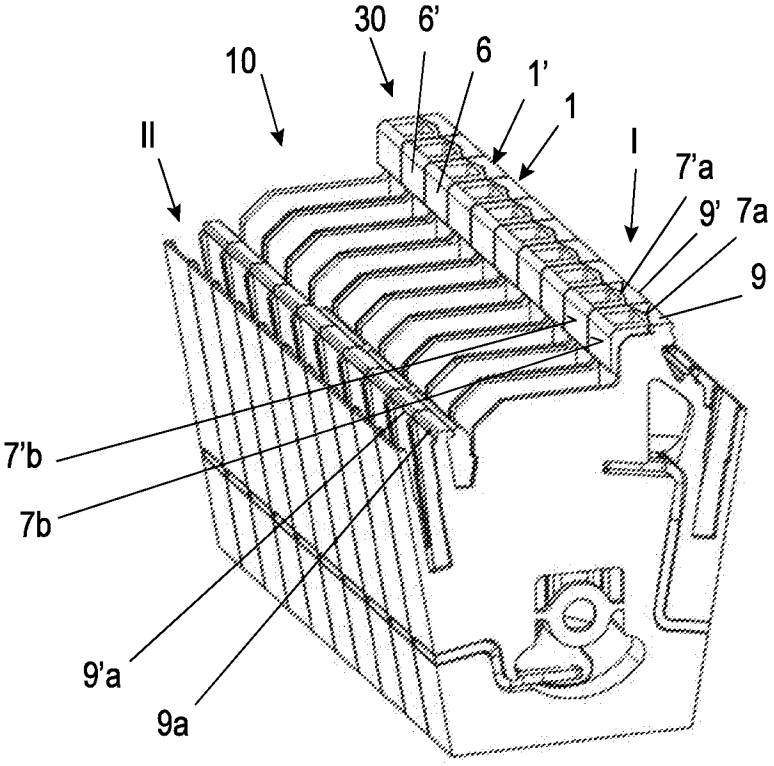

Schematic perspective views of arrangements 10 of disconnect terminals 1, 1' according to the invention are shown in FIGS. 41 and 41*a* in arrayed arrangements 10.

It is clearly visible here which disconnect terminals 1, 1' are in the switch position I and which are in the switch position II, since the associated end face sections 7*a*, 7'*a*; 7*b*, 7'*b* of the switching levers 6, 6' each rest on the stops 9, 9' and 9*a*, 9'*a*, respectively.

In the embodiments described, a first coupling position A and a second coupling position B and also an installation position C are specified. The number of possible coupling positions located in between and located outside these positions is not thus restricted.

The invention is not restricted by the above-explained embodiments.

The invention claimed is:

1. A disconnect terminal in particular for an assembly, comprising (a) at least one switching lever which is adjustable independently from another switching lever between a first switch position and at least one second switch position; and (b) a switch status display including a movable display portion and a fixed display portion, said switch status display visibly displaying a respective switch position of the switching levers, wherein in the first switch position, said movable and fixed display portions are unified to indicate a closed position of said switching lever and in the second switch position, said movable and fixed display portions are separated to indicate an open position of said switching lever.

2. The disconnect terminal as defined in claim 1, wherein the first and second switch positions are displayed by covering or exposing a display portion, respectively.

3. The disconnect terminal as defined in claim 1, wherein the switch status display incorporates one of coloring, symbols, and/or geometry.

4. An assembly, comprising (a) at least two disconnect terminals each of which includes at least one switching lever which is adjustable independently from another switching lever between a first switch position and at least one second switch position; and (b) at least one coupling device operable between a first coupling position in which said switching levers are connected and at least one second coupling position wherein said switching levers are separated, wherein at least one disconnect terminal includes a switch status display having a movable display portion and a fixed display portion which visibly displays the respective switch position or at least one further switch position of the switching levers, and wherein in the at least one first switch position, said display portions are unified to indicate a closed position of said disconnect terminal, and wherein in the at least one second switch position said display portions are separated to indicate an open position of said disconnect terminal.

5. The assembly as defined in claim 4, wherein the first and second switch positions are displayed by covering or exposing at least one display portion, respectively.

6. The assembly as defined in claim 4, wherein the switch status display incorporates one of coloring, symbols, and/or geometry.

7. An assembly, comprising (a) at least two disconnect terminals each of which includes at least one switching lever which is adjustable independently from another switching lever between a first switch position and at least one second switch position; and (b) at least one coupling element switchable between a first coupling position in which said switching levers are connected and at least one second coupling position wherein said switching levers are separated, said at least one coupling element being captively retained on the switching lever of one of the at least two disconnect terminals in the first coupling position and in the second coupling position.

8. An assembly, comprising (a) at least two disconnect terminals each of which includes at least one switching lever which is adjustable independently from another switching lever between a first switch position and at least one second switch position; and (b) at least one coupling element switchable linearly in the radial direction in relation to a pivot axis of said switching levers between a first coupling position in which said switching levers are connected and at least one second coupling position wherein said switching levers are separated, said at least one coupling element including at least one switch pin, at least one driver, and at least one handle, wherein the at least one switch pin is longer than the at least one driver.

9. The assembly as defined in claim 8, wherein said at least one coupling element is switchable linearly in the radial direction in relation to a pivot axis of the switching levers from the first coupling position into the second coupling position or into at least one further coupling position and back perpendicularly or at an angle in relation to the movement direction of a switching lever.

10. The assembly as defined in claim 8, wherein said at least one driver is engaged in the first coupling position with at least one receptacle of another switching lever and said at least one driver is disengaged in the second coupling position or in at least one further coupling position from the at least one receptacle of another switching lever.

11. The assembly as defined in claim 8, wherein said at least one coupling element is accommodated in a displaceably guided manner with the at least one switch pin in at least one receptacle of a switching lever of the at least one disconnect terminal and is fixed by a detent mechanism in the first coupling position and in the second coupling position or in the at least one further coupling position.

12. The assembly as defined in claim 11, wherein said at least one switch pin of said at least one coupling element includes at least one lug and at least one detent spring having at least one detent lug as a detent mechanism.

13. An assembly, comprising (a) at least two disconnect terminals each of which includes at least one switching lever which is adjustable independently from another switching lever between a first switch position and at least one second switch position; and (b) at least one coupling element captively retained on the switching lever of one of the at least two disconnect terminals and switchable between a first coupling position in which said switching levers are connected and at least one second coupling position wherein said switching levers are separated, wherein said at least one coupling element is switchable rotationally around an axis from the first coupling position into the second coupling position or into at least one further coupling position and back, the axis being tangential to a circle having a center point through which a pivot axis of the switching lever extends or the axis being coaxial or at an angle in relation to the movement direction of a switching lever.

14. The assembly as defined in claim 13, wherein said at least one coupling element is configured as an oblong hood and includes a pivot section, a shaft section having the axis, and at least one coupling section, wherein the shaft section of said at least one coupling element is pivotable around the axis in a receptacle of a radially protruding actuating section of the switching lever and is captively retained by an undercut.

15. The assembly as defined in claim 14, wherein said at least one coupling element is pivoted in the first coupling position via the radially protruding actuating section of another switching lever and is coupled thereto in a formfitting manner, the at least one coupling section of the at least one coupling element enclosing the radially protruding actuating section of the other switching lever.

16. The assembly as defined in claim 14, wherein said at least one coupling element is retained in the first coupling position in a first detent position, wherein at least one projection on an inner side of a side wall of the coupling section of the at least one coupling element is engaged with ends of the receptacle of the actuating section of another switching lever, the at least one coupling element being held in the second coupling position in a second detent position, wherein at least one detent device having a protruding section and an indented section corresponding thereto is provided.

17. The assembly as defined in claim 16, wherein the at least one actuating section of the at least one switching lever having corresponding receptacles is formed with at least one coupling element and the corresponding receptacles as at least one box-shaped region or receptacle sections each as a separate element attached to the at least one switching lever.

18. An assembly, comprising (a) at least two disconnect terminals each of which includes at least one switching lever which is adjustable independently from another switching lever between a first switch position and at least one second switch position; and (b) at least one coupling element switchable between a first coupling position in which said switching levers are connected and at least one second coupling position wherein said switching levers are separated, wherein said at least one coupling element is switchable rotationally around an axis from the first coupling position into the second coupling position or into at least one further coupling position and back, the axis being tangential to a circle having a center point through which a pivot axis of the switching lever extends or the axis being coaxial or at an angle in relation to the movement direction of a switching lever, and further wherein said at least one coupling element is pivotably arranged around at least one axis and retained in a receptacle in at least one actuating section of the at least one switching lever, the respective receptacle including at least one slot through which the at least one coupling element is installed.

19. The assembly as defined in claim 18, wherein the at least one coupling element is locked in each of the first coupling position and in the at least one second coupling position by at least one lug or at least one projection which is engaged in the respective coupling position with a respective fixed recess.

20. The assembly as defined in claim 18, wherein the at least one coupling element is switchable by a tool.

21. The assembly as defined in claim 18, wherein said at least one coupling element includes a cylindrical body having an associated pivot axis and at least one arm attached to the body having at least one hook section.

22. The assembly as defined in claim 21, wherein said at least one hook section extends in the first coupling position through the at least one slot and is engaged with at least one further receptacle of the actuating section of another switching lever, the at least one hook section remaining in the respective corresponding receptacle in the second coupling position.

* * * * *